US012017323B2

(12) United States Patent
Kobata et al.

(10) Patent No.: US 12,017,323 B2
(45) Date of Patent: Jun. 25, 2024

(54) POLISHING HEAD SYSTEM AND POLISHING APPARATUS

(71) Applicant: EBARA CORPORATION, Tokyo (JP)

(72) Inventors: Itsuki Kobata, Tokyo (JP); Hozumi Yasuda, Tokyo (JP); Akio Yanai, Tokyo (JP); Nobuyuki Takahashi, Tokyo (JP); Takamasa Nakamura, Tokyo (JP); Keisuke Sakata, Tokyo (JP); Nobuyuki Takada, Tokyo (JP); Yuji Yagi, Tokyo (JP); Yasuhiro Takada, Tokyo (JP); Katsuhide Watanabe, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 477 days.

(21) Appl. No.: 17/147,677

(22) Filed: Jan. 13, 2021

(65) Prior Publication Data

US 2021/0237224 A1 Aug. 5, 2021

(30) Foreign Application Priority Data

Jan. 17, 2020 (JP) ..... 2020-006393

(51) Int. Cl.
*B24B 37/10* (2012.01)
*B24B 37/005* (2012.01)

(52) U.S. Cl.
CPC ..... *B24B 37/10* (2013.01); *B24B 37/005* (2013.01)

(58) Field of Classification Search
CPC ..... B24B 37/30; B24B 37/015; B24B 37/005; B24B 37/042; B24B 37/10; B24B 37/11; B24B 37/27; B24B 37/34; B24B 49/16; B24B 49/10; B24B 49/14; B24B 49/12; B24B 47/12; B24B 47/20; B24B 47/22; H01L 21/67092
USPC ..... 451/287, 288, 289, 388
See application file for complete search history.

(56) References Cited

U.S. PATENT DOCUMENTS 5,868,896 A 2/1999 Robinson et al.
5,888,120 A 3/1999 Doran
6,325,696 B1 12/2001 Boggs et al.
6,859,984 B2 * 3/2005 Dinet ..... B06B 1/0629 29/760
7,285,037 B2 10/2007 Brown
(Continued)

FOREIGN PATENT DOCUMENTS

CN 1805824 A * 7/2006 ..... B24B 37/30
CN 101543974 A 9/2009
(Continued)

OTHER PUBLICATIONS

English translation of CN 110193774A (Year: 2019).*
(Continued)

*Primary Examiner* — Laura C Guidotti
*Assistant Examiner* — Sukwoo James Chang
(74) *Attorney, Agent, or Firm* — BakerHostetler

(57) ABSTRACT

A polishing head system capable of precisely controlling a film-thickness profile of a workpiece, such as a wafer, substrate, or panel, is disclosed. The polishing head system includes a polishing head having a plurality of piezoelectric elements configured to apply pressing forces to a workpiece, and an operation controller configured to determine instruction values of voltages to be applied to the plurality of piezoelectric elements.

29 Claims, 28 Drawing Sheets

(56) References Cited

U.S. PATENT DOCUMENTS

| | | | | |
|---|---|---|---|---|
| 7,357,695 | B2 | 4/2008 | Elledge | |
| 8,951,813 | B2 * | 2/2015 | Lizumi | B24B 37/013 451/64 |
| 2007/0004321 | A1 | 1/2007 | Elledge | |
| 2016/0354894 | A1 * | 12/2016 | Kimba | B24B 37/013 |
| 2019/0095797 | A1 * | 3/2019 | Dhandapani | H01L 22/20 |
| 2019/0286111 | A1 * | 9/2019 | Yennie | H01L 21/67253 |

FOREIGN PATENT DOCUMENTS

| | | | | | |
|---|---|---|---|---|---|
| CN | 109702560 | A | | 5/2019 | |
| CN | 208929972 | U | * | 6/2019 | B24B 37/005 |
| CN | 110193774 | A | * | 9/2019 | B24B 37/005 |
| DE | DD206612 | A | * | 2/1984 | H02J 7/24 |
| JP | H09-225820 | A | | 9/1997 | |
| JP | H10-128655 | A | | 5/1998 | |
| JP | H11-070460 | A | | 3/1999 | |
| JP | H11-165256 | A | | 6/1999 | |
| JP | 2000-006002 | A | | 1/2000 | |
| JP | 2000-246628 | A | | 9/2000 | |
| JP | 2017-047503 | A | | 3/2017 | |
| JP | 2020010556 | A | * | 1/2020 | H02J 7/32 |
| KR | 20020013583 | A | * | 2/2002 | G11B 5/5552 |
| KR | 20120103126 | A | * | 9/2012 | B24B 49/045 |
| NL | 2012419 | A | * | 11/2015 | A61F 5/48 |
| WO | WO 2006/105785 | A1 | | 10/2006 | |
| WO | WO2019069454 | A1 | * | 4/2019 | H05G 2/006 |

OTHER PUBLICATIONS

English translation of KR20020013583A (Year: 2002).*
English translation of CN208929972U (Year: 2019).*
Materials Science and Engineering Journal Paper by Zhang (Year: 2019).*
English translation of NL2012419A (Year: 2015).*
English translation of DD206612A (Year: 1984).*
English translation of JP 2020010556A (Year: 2020).*
English translation of WO2019069454A1 (Year: 2019).*
English translation of KR20120103126A (Year: 2012).*
English translation of CN1805824A (Year: 2006).*
Singapore Patent Application No. 10202100222W; Written Opinion and Search Report; dated Feb. 16, 2024; 9 pages.

* cited by examiner

POLISHING HEAD SYSTEM AND POLISHING APPARATUS

CROSS REFERENCE TO RELATED APPLICATION

This document claims priority to Japanese Patent Application No. 2020-006393 filed Jan. 17, 2020, the entire contents of which are hereby incorporated by reference.

BACKGROUND

In manufacturing of semiconductor devices, various types of films are formed on a wafer. In forming steps for interconnects and contacts, the wafer is polished after the film forming step in order to remove unnecessary portions of the film and surface irregularities. Chemical mechanical polishing (CMP) is a typical technique for wafer polishing. This CMP is performed by rubbing the wafer against a polishing surface while supplying a polishing liquid onto the polishing surface. The film formed on the wafer is polished by a combination of a mechanical action of abrasive grains contained in the polishing liquid or a polishing pad and a chemical action of chemical components of the polishing liquid.

FIG. 32 is a cross-sectional view showing a conventional polishing head used for CMP. A polishing head 400 has an elastic membrane 402 held on a lower surface of a carrier 401. This elastic membrane 402 has a plurality of concentric annular walls 402*a* to 402*d*. These annular walls 402*a* to 402*d* divide a space inside the elastic membrane 402 into a plurality of pressure chambers 405A to 405D. A compressed gas is supplied into these pressure chambers 405A to 405D. The elastic membrane 402 receives the pressure of the compressed gas that fills the respective pressure chambers 405A to 405D, and can press a wafer W against a polishing surface 500*a* of a polishing pad 500. The plurality of pressure chambers 405A to 405D communicate with a plurality of pressure regulators R1 to R4, respectively. These pressure regulators R1 to R4 can independently regulate the pressures of the compressed gas in the corresponding pressure chambers 405A to 405D, so that the polishing head 400 can press different regions of the wafer W with different pressing forces.

The accuracy required for each process in the manufacturing of semiconductor devices these days has already reached the order of several nm, and CMP is no exception. In addition, with the increasing integration of semiconductor integrated circuits, microfabrication and multi-layering are accelerating. Therefore, in order to realize these microfabrication and multi-layering, it is required to achieve a small variation in the remaining film thickness within the order of several nm over the entire surface of the wafer W after CMP. In order to achieve this requirement, a polishing technique capable of controlling a film-thickness profile with a resolution of, for example, a chip size level in an in-plane direction of the wafer W is required.

A step of forming a film on the wafer W is performed by using various film forming techniques, such as plating, chemical vapor deposition (CVD), or physical vapor deposition (PVD). With these film forming techniques, the film may not be uniformly formed over the entire surface of the wafer W. For example, there may be a variation in the film thickness along the circumferential direction of the wafer W.

The conventional polishing head 400 shown in FIG. 32 can independently change the pressing forces along the radial direction of the wafer W, and can therefore control the film-thickness profile of the wafer W in the radial direction. However, since the arrangement of the pressure chambers 405A to 405D is concentric, the above-described polishing head 400 cannot control pressing forces along the circumferential direction of the wafer W, and cannot control a film-thickness profile in the circumferential direction of the wafer W. One possible solution for this is to divide a pressure chamber in the circumferential direction. However, in the realization of such structure, there are practical restrictions on the dimensions of the pressure chambers and on the number of lines for supplying the compressed gas to each pressure chamber. Accordingly, it is difficult to control the film-thickness profile with, for example, the resolution of the chip size level formed on the surface of the wafer W.

SUMMARY OF THE INVENTION

Therefore, in view of the above problems, there is provided a polishing head system capable of precisely controlling a film-thickness profile of a workpiece, such as a wafer, a substrate, or a panel. There is also provided a polishing apparatus including such a polishing head system.

Embodiments, which will be described below, relate to a polishing head system configured to press a workpiece, such as a wafer, a substrate, or a panel, against a polishing surface of a polishing pad to polish the workpiece. Embodiments, which will be described below, also relate to a polishing apparatus including such a polishing head system.

In an embodiment, there is provided a polishing head system for polishing a workpiece by pressing the workpiece against a polishing surface while moving the workpiece and the polishing surface relative to each other in a presence of a polishing liquid, comprising: a polishing head having a plurality of actuators configured to apply pressing forces to a plurality of regions of the workpiece; a drive source configured to operate the plurality of actuators; and an operation controller configured to determine a plurality of instruction values and transmits the plurality of instruction values to the drive source.

In an embodiment, the plurality of actuators comprise a plurality of piezoelectric elements, the drive source comprises a drive-voltage application device including a power supply unit and a voltage controller, the power supply unit is configured to apply voltages to the plurality of piezoelectric elements independently, and the operation controller is configured to determine a plurality of instruction values of the voltages to be applied to the plurality of piezoelectric elements.

In an embodiment, the plurality of piezoelectric elements are arranged along a radial direction and a circumferential direction of the polishing head.

In an embodiment, an arrangement of the plurality of piezoelectric elements in the polishing head is any one or a combination of a grid arrangement, a concentric arrangement, and a staggered arrangement.

In an embodiment, the polishing head further includes a plurality of pressing members coupled to the plurality of piezoelectric elements, respectively, and the plurality of pressing members has a plurality of first surfaces facing the plurality of piezoelectric elements, respectively, and a plurality of second surfaces for pressing the workpiece.

In an embodiment, the plurality of second surfaces have at least one of a circular shape, an ellipse shape, a polygonal shape, and an arc shape.

In an embodiment, a facing area of the plurality of first surfaces is larger than a facing area of the plurality of second surfaces.

In an embodiment, at least two piezoelectric elements are coupled to one pressing member.

In an embodiment, the polishing head further includes a holding member holding the plurality of pressing members such that the plurality of pressing members are movable within a limited range.

In an embodiment, the holding member is configured to limit a range of movement of the plurality of pressing members in a direction perpendicular to a direction of pressing the workpiece.

In an embodiment, the plurality of pressing members include a plurality of gimbal mechanisms, respectively, the plurality of gimbal mechanisms having a plurality of movable members which are tiltable in all directions, and the plurality of movable members have the plurality of second surfaces, respectively.

In an embodiment, the polishing head further includes an elastic membrane having a contact surface with the workpiece.

In an embodiment, the polishing head system further comprises: an elastic membrane forming a pressure chamber in the polishing head; and a compressed-gas supply line communicating with the pressure chamber, the pressure chamber being located between the plurality of pressing members and the elastic membrane.

In an embodiment, the polishing head system further comprises: an elastic sheet forming a pressure chamber in the polishing head; and a compressed-gas supply line communicating with the pressure chamber, the plurality of piezoelectric elements being located between the elastic sheet and the plurality of pressing members.

In an embodiment, the polishing head further includes a plurality of pressing-force measuring devices configured to measure pressing forces generated by the plurality of piezoelectric elements, respectively.

In an embodiment, the plurality of pressing-force measuring devices are arranged between the plurality of piezoelectric elements and the plurality of pressing members.

In an embodiment, the plurality of pressing-force measuring devices are a plurality of piezoelectric sensors.

In an embodiment, the polishing head further includes a voltage distributor electrically coupled to the drive-voltage application device and the plurality of piezoelectric elements, the voltage distributor being configured to distribute the voltage applied from the drive-voltage application device to the plurality of piezoelectric elements.

In an embodiment, the voltage distributor has a branch device configured to distribute the voltage applied from the drive-voltage application device to the plurality of piezoelectric elements, and a communication device coupled to the branch device and the drive-voltage application device.

In an embodiment, the voltage distributor further has a plurality of plungers contacting the plurality of piezoelectric elements, and power distribution wires electrically coupling the plurality of plungers to the branch device.

In an embodiment, the voltage distributor is detachably attached to the polishing head.

In an embodiment, the polishing head further includes a temperature measuring device configured to measure a temperature of the plurality of piezoelectric elements.

In an embodiment, the polishing head system further comprises a vacuum line communicating with a workpiece contact surface of the polishing head.

In an embodiment, the polishing head further includes a retainer ring located outwardly of the plurality of piezoelectric elements, and at least three workpiece chuck mechanisms fixed to the retainer ring.

In an embodiment, the power supply unit is a DC power supply.

In an embodiment, there is provided a polishing apparatus for a workpiece, comprising: a polishing table configured to hold a polishing pad; a polishing-liquid supply nozzle configured to supplying a polishing liquid to the polishing pad; and the polishing head system.

In an embodiment, the polishing apparatus further comprises a film-thickness sensor configured to measure a film thickness of the workpiece, the film-thickness sensor being arranged in the polishing table.

In an embodiment, the operation controller is configured to produce a film-thickness profile of the workpiece from measured values of the film thickness acquired by the film-thickness sensor, and to instruct the drive source to drive the plurality of actuators based on the film-thickness profile.

In an embodiment, the operation controller is configured to determine a drive condition of the plurality of actuators based on a difference between the film-thickness profile and a target film-thickness profile, and to instruct the drive source.

In an embodiment, there is provided a polishing apparatus for a workpiece, comprising: a polishing table configured to hold a polishing pad; a polishing-liquid supply nozzle configured to supply a polishing liquid to the polishing pad; and the polishing head system.

In an embodiment, the polishing apparatus further comprises a film-thickness sensor configured to measure a film thickness of the workpiece, the film-thickness sensor being arranged in the polishing table.

In an embodiment, the operation controller is configured to produce a film-thickness profile of the workpiece from measured values of the film thickness acquired by the film-thickness sensor, and to determine instruction values of the voltages to be applied to the plurality of piezoelectric elements based on the film-thickness profile.

In an embodiment, the operation controller is configured to determine the instruction values of the voltages to be applied to the plurality of piezoelectric elements based on a difference between the film-thickness profile and a target film-thickness profile.

In an embodiment, the polishing apparatus further comprises a loading and unloading device configured to allow the polishing head to hold the workpiece.

In an embodiment, the polishing apparatus further comprises an orientation detector configured to detect an orientation of the workpiece in its circumferential direction.

In an embodiment, there is provided a polishing system for polishing a workpiece, comprising: the polishing apparatus; a cleaning device configured to clean the workpiece after polishing of the workpiece; a drying device configured to dry the workpiece after cleaning of the workpiece; and a transport device configured to transport the workpiece between the polishing apparatus, the cleaning device, and the drying device.

According to the above-described embodiments, the plurality of piezoelectric elements can press different portions (or regions) of a workpiece with different forces. Therefore, the polishing head can precisely control a film-thickness profile of the workpiece.

DESCRIPTION OF EMBODIMENTS

Figure 1:
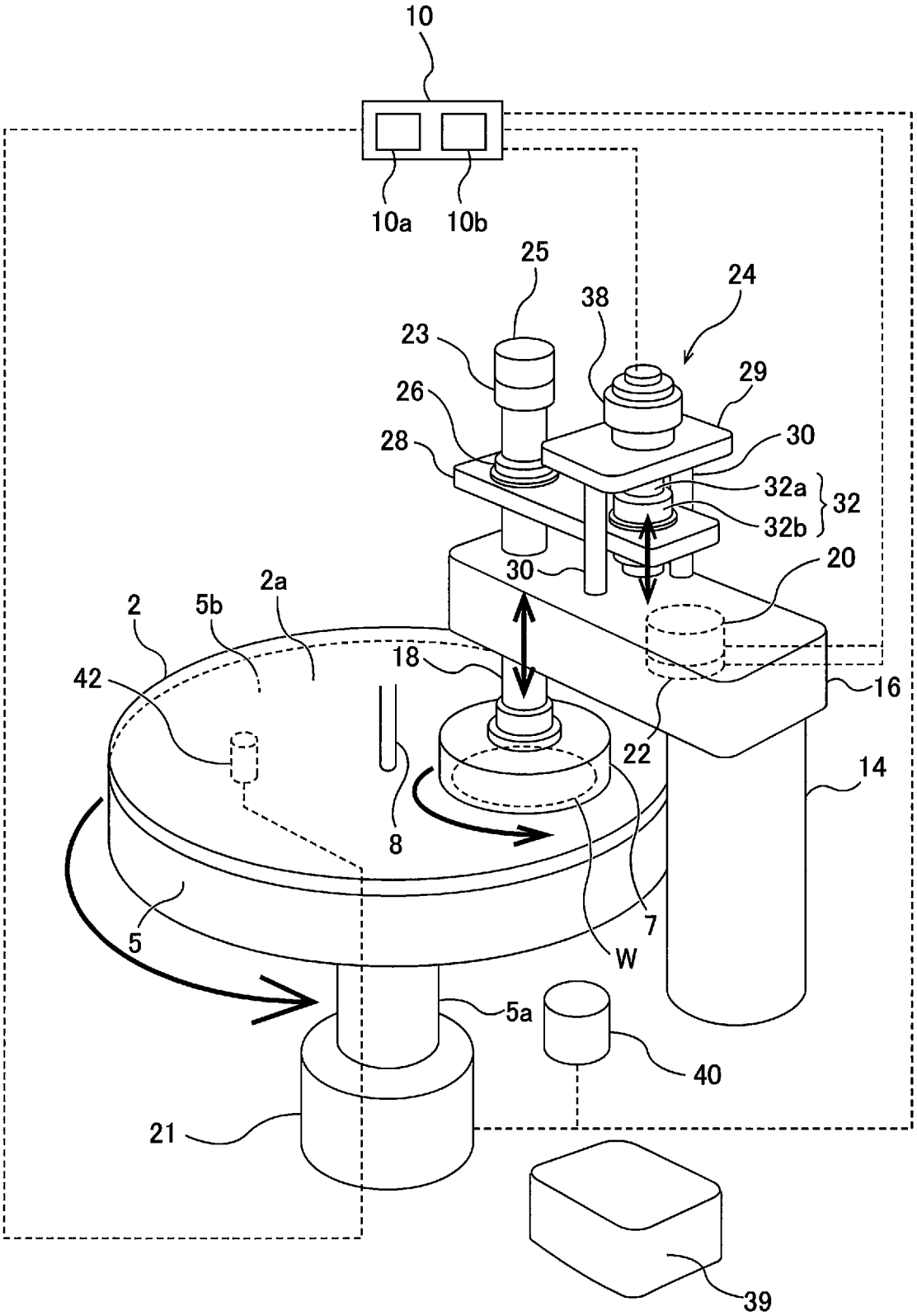
FIG. 1 is a schematic view showing an embodiment of a polishing apparatus.

Hereinafter, embodiments will be described with reference to the drawings. FIG. 1 is a schematic view showing an embodiment of a polishing apparatus. The polishing apparatus is an apparatus configured to chemically and mechanically polish a workpiece, such as a wafer, a substrates, or a panel. As shown in FIG. 1, this polishing apparatus includes a polishing table 5 that supports a polishing pad 2 having a polishing surface 2*a*, a polishing head 7 configured to press a workpiece W against the polishing surface 2*a*, a polishing-liquid supply nozzle 8 configured to supply a polishing liquid (for example, slurry containing abrasive grains) to the polishing surface 2*a*, and an operation controller 10 configured to control operations of the polishing apparatus. The polishing head 7 is configured to be able to hold the workpiece W on its lower surface.

The operation controller 10 includes a memory 10*a* storing programs therein, and an arithmetic device 10*b* configured to perform arithmetic operations according to instructions contained in the programs. The memory 10*a* includes a main memory, such as a RAM, and an auxiliary memory, such as a hard disk drive (HDD) or a solid state drive (SSD). Examples of the arithmetic device 10*b* include a CPU (central processing unit) and a GPU (graphic processing unit). However, the specific configuration of the operation controller 10 is not limited to these examples.

The operation controller 10 is composed of at least one computer. The at least one computer may be one server or a plurality of servers. The operation controller 10 may be an edge server, a cloud server connected to a communication network, such as the Internet or a local area network, or a fog computing device (gateway, Fog server, router, etc.) installed in the network. The operation controller 10 may be a plurality of servers connected by a communication network, such as the Internet or a local area network. For example, the operation controller 10 may be a combination of an edge server and a cloud server.

The polishing apparatus further includes a support shaft 14, a polishing-head oscillation arm 16 coupled to an upper end of the support shaft 14, a polishing-head shaft 18 rotatably supported by a free end of the polishing-head oscillation arm 16, and a rotating motor 20 configured to rotate the polishing head 7 about its central axis. The rotating motor 20 is fixed to the polishing-head oscillation arm 16 and is coupled to the polishing-head shaft 18 via a torque transmission mechanism (not shown) constituted by a belt, pulleys or the like. The polishing head 7 is fixed to a lower end of the polishing-head shaft 18. The rotating motor 20 rotates the polishing-head shaft 18 via the above torque transmission mechanism, so that the polishing head 7 rotates together with the polishing-head shaft 18. In this way, the polishing head 7 is rotated about the central axis thereof by the rotating motor 20 in a direction indicated by arrow.

The rotating motor 20 is coupled to a rotary encoder 22 as a rotation angle detector configured to detect a rotation angle of the polishing head 7. The rotary encoder 22 is configured to detect a rotation angle of the rotating motor 20. The rotation angle of the rotating motor 20 coincides with the rotation angle of the polishing head 7. Therefore, the rotation angle of the rotating motor 20 detected by the rotary encoder 22 corresponds to the rotation angle of the polishing head 7. The rotary encoder 22 is coupled to the operation controller 10, and a detection value of the rotation angle of the rotating motor 20 output from the rotary encoder 22 (i.e., a detection value of the rotation angle of the polishing head 7) is sent to the operation controller 10.

The polishing apparatus further includes a rotating motor 21 configured to rotate the polishing pad 2 and the polishing table 5 about their central axes. The rotating motor 21 is arranged below the polishing table 5, and the polishing table 5 is coupled to the rotating motor 21 via a rotation shaft 5*a*. The polishing table 5 and the polishing pad 2 are rotated about the rotation shaft 5*a* by the rotating motor 21 in a direction indicated by arrow. The central axes of the polishing pad 2 and the polishing table 5 coincide with the central axis of the rotation shaft 5*a*. The polishing pad 2 is attached to a pad support surface 5*b* of the polishing table 5. An exposed surface of the polishing pad 2 constitutes a polishing surface 2*a* for polishing the workpiece W, such as a wafer.

The polishing-head shaft 18 can move up and down relative to the polishing-head oscillation arm 16 by an elevating mechanism 24, so that the polishing head 7 is able to move up and down relative to the polishing-head oscillation arm 16 and the polishing table 5 by the vertical movement of the polishing-head shaft 18. A rotary connector 23 and a rotary joint 25 are attached to an upper end of the polishing-head shaft 18.

The elevating mechanism 24 for elevating and lowering the polishing-head shaft 18 and the polishing head 7 includes a bearing 26 that rotatably supports the polishing-head shaft 18, a bridge 28 to which the bearing 26 is fixed, a ball-screw mechanism 32 attached to the bridge 28, a support base 29 supported by support columns 30, and a servomotor 38 fixed to the support base 29. The support base 29 that supports the servomotor 38 is coupled to the polishing-head oscillation arm 16 via the support columns 30.

The ball-screw mechanism 32 includes a screw shaft 32*a* coupled to the servomotor 38 and a nut 32*b* into which the screw shaft 32*a* is screwed. The nut 32*b* is fixed to the bridge 28. The polishing-head shaft 18 is configured to move up and down (i.e., move in the vertical directions) together with the bridge 28. Therefore, when the servomotor 38 drives the ball-screw mechanism 32, the bridge 28 moves up and down to cause the polishing-head shaft 18 and the polishing head 7 to move up and down.

The elevating mechanism 24 functions as a polishing-head positioning mechanism for adjusting a height of the polishing head 7 relative to the polishing table 5. When polishing of the workpiece W is to be performed, the elevating mechanism 24 positions the polishing head 7 at a predetermined height. With the polishing head 7 maintained at the predetermined height, the polishing head 7 presses the workpiece W against the polishing surface 2*a* of the polishing pad 2.

The polishing apparatus includes an arm-pivoting motor (not shown) configured to cause the polishing-head oscillation arm 16 to pivot around the support shaft 14. When the arm-pivoting motor causes the polishing-head oscillation arm 16 to pivot, the polishing head 7 can move between a polishing position above the polishing table 5 and a loading and unloading position outside the polishing table 5. The workpiece W to be polished is attached to the polishing head 7 by a loading and unloading device 39 at the loading and unloading position, and then moved to the polishing position. The polished workpiece W is moved from the polishing position to the loading and unloading position, and is removed from the polishing head 7 by the loading and unloading device 39 at the loading and unloading position. In FIG. 1, the loading and unloading device 39 is schematically depicted. The position and configuration of the loading and unloading device 39 are not particularly limited as long as its intended purpose can be achieved.

The polishing apparatus includes a notch aligner 40 as an orientation detector configured to detect an orientation of the workpiece W in the circumferential direction of the workpiece W. Although the notch aligner 40 is independently arranged in the polishing apparatus in this figure, the notch aligner 40 may be integrally arranged with the loading and unloading device 39. The notch aligner 40 is a device for detecting a notch (or a cut) formed in an edge of the workpiece W. The specific configuration of the notch aligner 40 is not particularly limited as long as it can detect the notch. In one example, the notch aligner 40 is an optical notch detector configured to apply a laser beam to the edge of the workpiece W while rotating the workpiece W, and to detect the reflected laser beam by a light receiving unit. This type of notch detector can detect the position of the notch because the intensity of the received laser light changes at the notch position. Another example is a liquid notch detector configured to emit a jet of a liquid, such as pure water, from a nozzle arranged close to the edge of the workpiece W to the edge of the workpiece W while rotating the workpiece W, and detect pressure or flow rate of the liquid flowing toward the nozzle. This type of notch detector can detect the position of the notch because the pressure or flow rate of the liquid changes at the notch position.

The detection of the notch, i.e., the detection of the orientation of the workpiece W in the circumferential direction is performed before polishing of the workpiece W. The purpose of detecting the notch is to recognize and correct the arrangement of the workpiece W with respect to arrangements of piezoelectric elements which will be described later. The detection of the notch may be performed before the workpiece W is held by the polishing head 7, or may be performed with the workpiece W held by the polishing head 7. For example, in the case where the detection of the notch is performed before the workpiece W is held by the polishing head 7, the notch position of the workpiece W is detected by the notch aligner 40 at the loading and unloading position. Then, the polishing head 7 is rotated until the detected notch position reaches a specific position of the polishing head 7. Thereafter, the workpiece W is transferred to a workpiece contact surface 56*a* of a holding member 56 of the polishing head 7 by the loading and unloading device, so that the workpiece W is held by the polishing head 7 by vacuum suction or other technique.

The notch aligner 40 is coupled to the operation controller 10. The operation controller 10 is configured to associate the position of the notch of the workpiece W with the rotation angle of the polishing head 7. More specifically, the operation controller 10 designates a reference position of the rotation angle of the polishing head 7 based on the position of the notch detected by the notch aligner 40, and stores the reference position of the rotation angle in the memory 10*a*. Then, the notch position detected by the notch aligner 40 is also stored in the memory 10*a* at the same time. The operation controller 10 compares the reference position with the notch position, so that the operation controller 10 can determine a position on the surface of the workpiece W based on the reference position of the rotation angle of the polishing head 7.

Then, for example, the polishing head 7 is rotated by a certain angle by the rotating motor 20 such that the notch position of the workpiece W is corrected so as to be at a predetermined angle with respect to the reference position of the polishing head 7. Thereafter, the workpiece W is transferred to the loading and unloading device and held by the polishing head 7. Once the reference position of the rotation angle of the polishing head 7 is set based on the arrangement of the piezoelectric elements described later, the polishing head 7 can hold the workpiece W in a state such that the workpiece W corresponds to the specific arrangement of the piezoelectric elements.

Polishing of the workpiece W is performed as follows. The workpiece W, with its surface to be polished facing downward, is held by the polishing head 7. While the polishing head 7 and the polishing table 5 are rotating independently, the polishing liquid (for example, slurry containing abrasive grains) is supplied onto the polishing surface 2*a* of the polishing pad 2 from the polishing-liquid supply nozzle 8 provided above the polishing table 5. The polishing pad 2 rotates about its central axis together with the polishing table 5. The polishing head 7 is moved to the predetermined height by the elevating mechanism 24. Further, while the polishing head 7 is maintained at the above predetermined height, the polishing head 7 presses the workpiece W against the polishing surface 2*a* of the polishing pad 2. The workpiece W rotates together with the polishing head 7. Specifically, the workpiece W rotates at the same speed as the polishing head 7. The workpiece W is rubbed against the polishing surface 2*a* of the polishing pad 2 in the presence of the polishing liquid on the polishing surface 2*a* of the polishing pad 2. The surface of the workpiece W is polished by a combination of the chemical action of the polishing liquid and the mechanical action of the abrasive grains contained in the polishing liquid or the polishing pad 2.

The polishing apparatus includes a film-thickness sensor 42 configured to measure a film thickness of the workpiece W on the polishing surface 2*a*. The film-thickness sensor 42 is configured to generate a film-thickness index value that directly or indirectly indicates the film thickness of the workpiece W. This film-thickness index value changes according to the film thickness of the workpiece W. The film-thickness index value may be a value representing the film thickness of the workpiece W itself, or may be a physical quantity or a signal value before being converted into the film thickness.

Examples of the film-thickness sensor 42 include an eddy current sensor and an optical film-thickness sensor. The film-thickness sensor 42 is arranged in the polishing table 5 and rotates together with the polishing table 5. More specifically, the film-thickness sensor 42 is configured to measure the film thickness at a plurality of measurement points of the workpiece W while moving across the workpiece W on the polishing surface 2*a* each time the polishing table 5 makes one rotation. The film-thickness index values representing the film thicknesses at the plurality of measurement points are output from the film-thickness sensor 42, and are sent to the operation controller 10. The operation controller 10 is configured to control the operation of the polishing head 7 based on the film-thickness index values.

Figure 2:
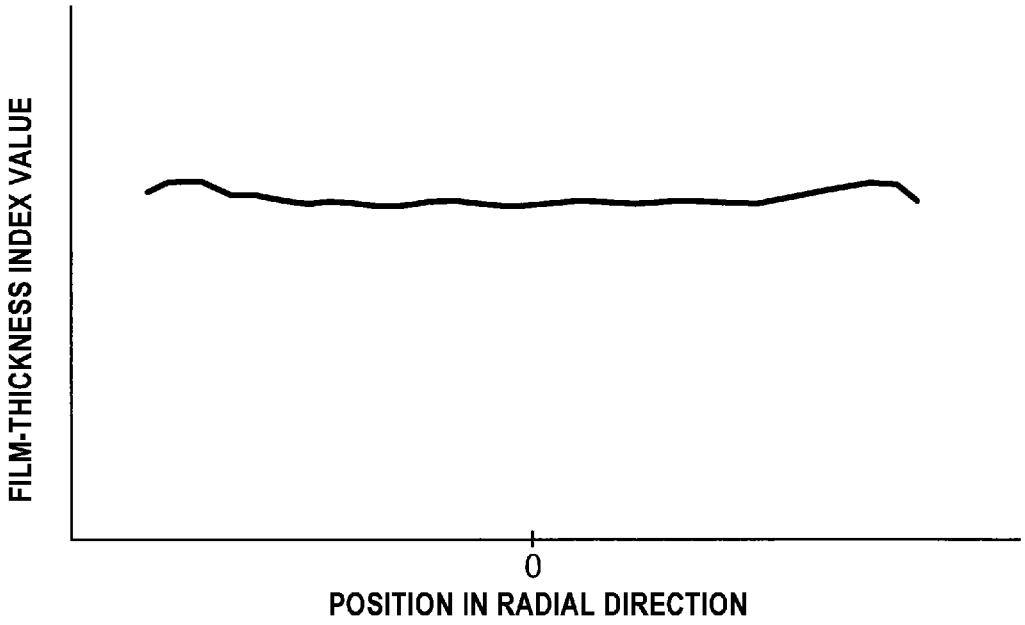
FIG. 2 is a diagram showing an example of a film-thickness profile of a workpiece.

The operation controller 10 produces a film-thickness profile of the workpiece W from the film-thickness index values output from the film-thickness sensor 42. The film-thickness profile of the workpiece W is a distribution of film-thickness index values. FIG. 2 is a diagram showing an example of the film-thickness profile of the workpiece W. In FIG. 2, a vertical axis represents film-thickness index value that directly or indirectly indicates the film thickness of the workpiece W, and a horizontal axis represents the position of the workpiece W in its radial direction. The film thickness measurement points are aligned along the radial direction of the workpiece W. Therefore, the film-thickness index values output from the film-thickness sensor 42 are distributed along the radial direction of the workpiece W. The film-thickness profile shown in FIG. 2 is a film-thickness profile along the radial direction of the workpiece W.

Figure 3:
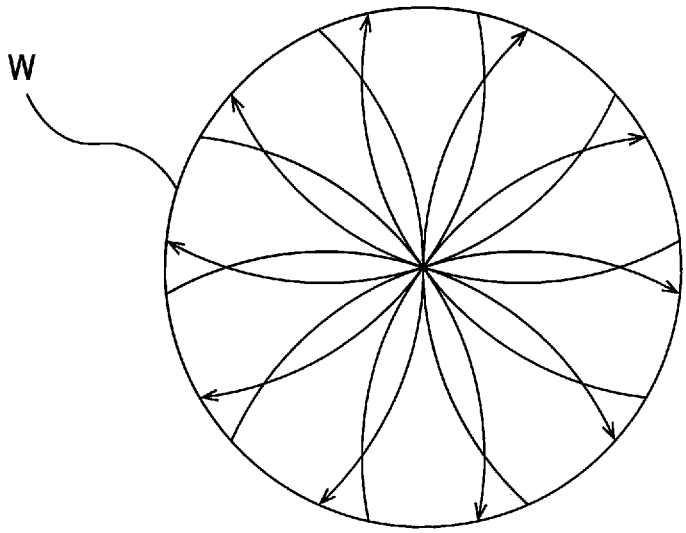
FIG. 3 is a diagram showing a path of a film-thickness sensor when traversing the workpiece.

FIG. 3 is a diagram showing a path of the film-thickness sensor 42 when traversing the workpiece W. During polishing of the workpiece W, the polishing table 5 and the polishing head 7 rotate at different speeds. Under such conditions, as shown in FIG. 3, the film-thickness sensor 42 moves across the workpiece W in a different path each time the polishing table 5 makes one rotation. More specifically, each time the polishing table 5 makes one rotation, the path of the film-thickness sensor 42 rotates around the center of the workpiece W at a constant angle. As can be seen from FIG. 3, when the polishing table 5 is rotated multiple times, the film-thickness sensor 42 can scan almost the entire workpiece W and can measure the film thickness over the almost entire workpiece W. In this figure, one film-thickness sensor 42 is provided in the polishing table 5, but a plurality of film-thickness sensors 42 may be provided in the polishing table 5, so that more detailed film-thickness profile can be obtained.

Figure 4:
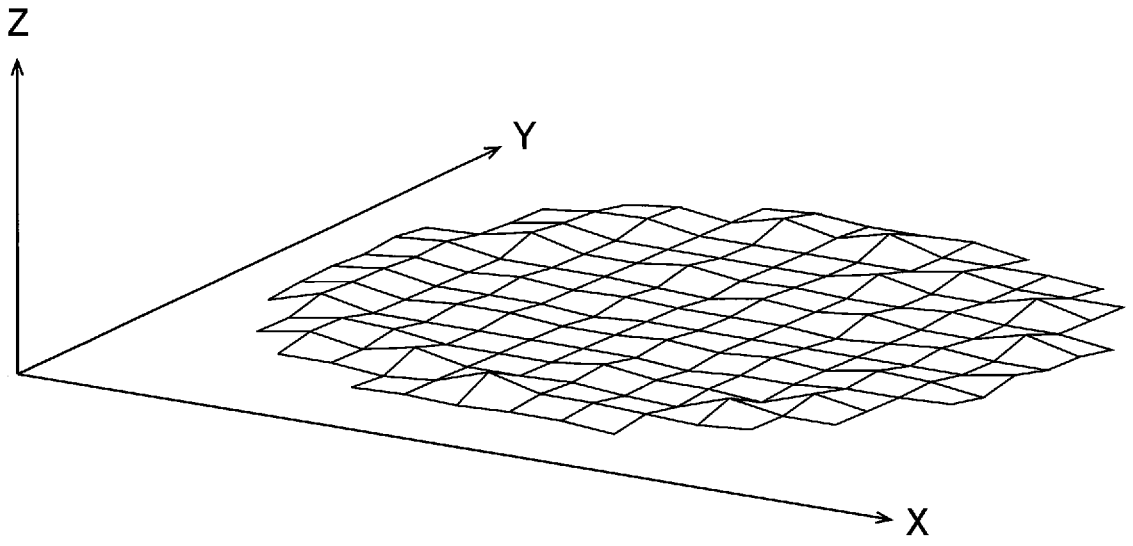
FIG. 4 is a diagram showing a film-thickness profile of an entire surface, to be polished, of the workpiece.

From the film-thickness index values obtained by the film-thickness sensor 42 while the polishing table 5 is rotating multiple times, the operation controller 10 produces a film-thickness profile of the entire surface, to be polished, of the workpiece W as shown in FIG. 4. FIG. 4 is a diagram showing the film-thickness profile of the entire surface, to be polished, of the workpiece W represented on an XYZ coordinate system. In FIG. 4, an X-axis represents a direction parallel to the surface, to be polished, of the workpiece W, a Y-axis represents a direction parallel to the surface, to be polished, of the workpiece W and perpendicular to the X direction, and a Z-axis represents the film-thickness index value. A position on the surface, to be polished, of the workpiece W is represented by coordinates on the X-axis and the Y-axis. The film-thickness index value that directly or indirectly indicates the film thickness of the workpiece W is represented by a coordinate on the Z-axis. The film-thickness profile of the entire surface, to be polished, of the workpiece W created by the operation controller 10 is stored in the memory 10*a*.

Figure 5:
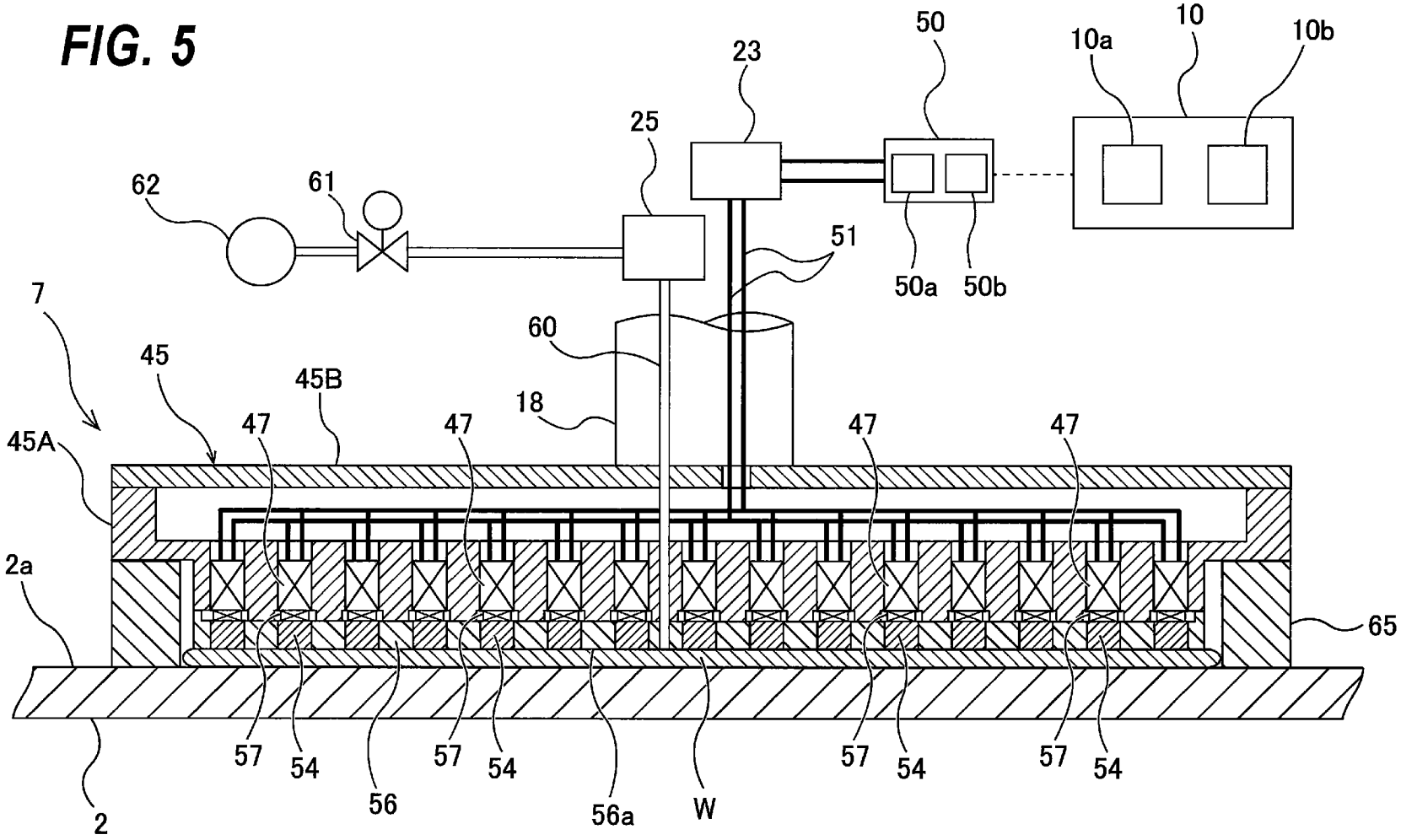
FIG. 5 is a cross-sectional view showing an embodiment of a polishing head system including a polishing head shown in FIG. 1.

FIG. 5 is a cross-sectional view showing an embodiment of a polishing head system including the polishing head 7 shown in FIG. 1. As shown in FIG. 5, the polishing head system includes the above-discussed polishing head 7, the operation controller 10, and a drive-voltage application device 50. The polishing head 7 includes a carrier 45 fixed to the lower end of the polishing-head shaft 18, and a plurality of piezoelectric elements 47 held by the carrier 45. The polishing head 7 is rigidly fixed to the lower end of the polishing-head shaft 18, so that the angle of the polishing head 7 with respect to the polishing-head shaft 18 is fixed. The plurality of piezoelectric elements 47 are located at the back side of the workpiece W.

The carrier 45 has a housing 45A that holds the plurality of piezoelectric elements 47, and a flange 45B that is detachably attached to the housing 45A. The flange 45B is fixed to the housing 45A by screw (not shown). Although not shown, a lid for maintenance may be provided on the housing 45A. When the lid is removed, a user can access the piezoelectric elements 47. The lid of the flange 45B is removed when maintenance, such as replacement of the piezoelectric element 47 or position adjustment of the piezoelectric element 47, is required.

The polishing head 7 includes a plurality of actuators capable of independently applying a plurality of pressing forces to the workpiece W. Such actuators may be hydraulic actuators (e.g., hydraulic cylinders or hydraulic motors), pneumatic actuators (e.g., pneumatic motors or pneumatic cylinders), electric actuators (e.g., electric motors), actuators using piezoelectric elements described later, magnetostrictive actuators using magnetostrictive elements, electromagnetic actuators (e.g., linear motors), small pistons, or the like.

In this embodiment, the plurality of piezoelectric elements 47 are adopted as the plurality of actuators capable of applying a plurality of pressing forces to the workpiece W independently. The piezoelectric elements 47 are electrically connected to the drive-voltage application device 50 through power lines 51. The piezoelectric elements 47 are driven by the drive-voltage application device 50 as a drive source. The power lines 51 extend via the rotary connector 23. The drive-voltage application device 50 includes a power supply unit 50*a* and a voltage controller 50*b*. The voltage controller 50*b* is configured to send instruction values of voltage, to be applied to the piezoelectric elements 47, to the power supply unit 50*a*. The drive-voltage application device 50 is configured to apply voltages independently to the piezoelectric elements 47, respectively. The drive-voltage application device 50 is coupled to the operation controller 10. The operation controller 10 is configured to determine the plurality of instruction values of voltages to be applied to the plurality of piezoelectric elements 47, and send the determined plurality of instruction values to the voltage controller 50*b* of the drive-voltage application device 50. The voltage controller 50*b* is configured to instruct the power supply unit 50*a* according to these instruction values, so that the power supply unit 50*a* applies a predetermined voltage to each piezoelectric element 47. The power supply unit 50*a* is composed of a DC power supply, an AC power supply, or a programmable power supply in which a voltage pattern can be set, or a combination thereof.

The polishing head 7 further includes a plurality of pressing members 54 coupled to the plurality of piezoelectric elements 47, respectively, a holding member 56 that holds the plurality of pressing members 54, and a plurality of pressing-force measuring devices 57 configured to measure a plurality of pressing forces generated by the plurality of piezoelectric elements 47, respectively. The plurality of pressing members 54 and the holding member 56 face the back side of the workpiece W.

When the drive-voltage application device 50 applies the voltages to the plurality of piezoelectric elements 47, respectively, these piezoelectric elements 47 expand toward the pressing members 54. The expansion of the piezoelectric elements 47 generates the pressing forces that press the workpiece W against the polishing surface 2*a* of the polishing pad 2 via the pressing members 54. In this way, the piezoelectric elements 47 to which the voltages are applied can independently apply the pressing forces to the workpiece W, and can therefore press a plurality of portions (or regions) of the workpiece W against the polishing surface 2*a* with different pressing forces.

In one embodiment, the plurality of pressing members 54 and the holding member 56 may be omitted, and the plurality of piezoelectric elements 47 may directly press the back surface of the workpiece W so as to press the workpiece W against the polishing surface 2*a* of the polishing pad 2.

The polishing head system further includes a vacuum line 60 that enables the polishing head 7 to hold the workpiece W by vacuum suction. The vacuum line 60 extends via the rotary joint 25 and communicates with the workpiece contact surface 56*a* of the polishing head 7. More specifically, one end of the vacuum line 60 is open in the workpiece contact surface 56*a* of the polishing head 7, and the other end of the vacuum line 60 is coupled to a vacuum source 62, such as a vacuum pump. A vacuum valve 61 is attached to the vacuum line 60. The vacuum valve 61 is an actuator-driven on-off valve (for example, an electric-motor-operated valve, a solenoid valve, an air-operated valve), and is coupled to the operation controller 10. The operation of the vacuum valve 61 is controlled by the operation controller 10. When the operation controller 10 opens the vacuum valve 61, the vacuum line 60 forms a vacuum on the workpiece contact surface 56*a* of the polishing head 7, whereby the polishing head 7 can hold the workpiece W on the workpiece contact surface 56*a* of the polishing head 7 by the vacuum suction.

In one embodiment, in order to prevent the workpiece W from rotating relative to the polishing head 7 during polishing of the workpiece W (i.e., in order to fix the position of the workpiece W relative to the polishing head 7), the vacuum line 60 may form the vacuum on the workpiece contact surface 56*a* of the polishing head 7 to hold the workpiece W on the workpiece contact surface 56*a* of the polishing head 7 by the vacuum suction. In this figure, one vacuum line 60 is arranged at the center of the workpiece W, but a plurality of vacuum lines 60 that are open at a plurality of locations in the workpiece contact surface 56*a* may be provided.

The polishing head 7 further includes a retainer ring 65 arranged outwardly of the plurality of piezoelectric elements 47. The retainer ring 65 is held by the carrier 45. The retainer ring 65 is arranged so as to surround the workpiece W and the pressing members 54, and is configured to prevent the workpiece W from coming off the polishing head 7 during polishing of the workpiece W. In the present embodiment, the retainer ring 65 is fixed to the carrier 45, while in one embodiment, an actuator, such as an airbag, may be arranged between the retainer ring 65 and the carrier 45, and the retainer ring 65 may be held by the carrier 45 such that the retainer ring 65 can move relative to the carrier 45.

Figure 6:
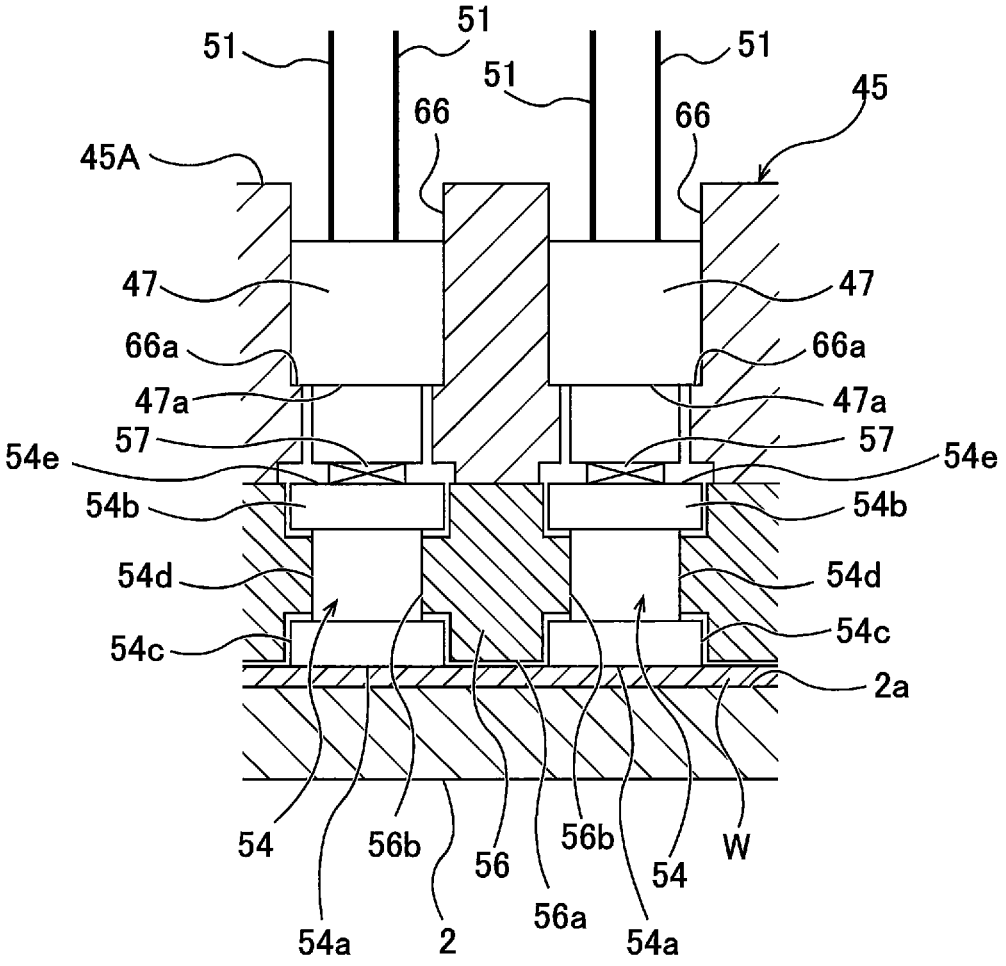
FIG. 6 is an enlarged cross-sectional view showing a part of the polishing head.
Figure 7:
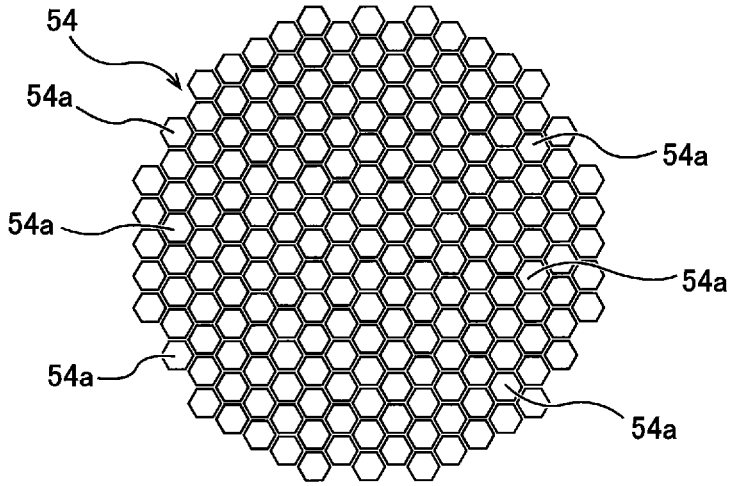
FIG. 7 is a schematic view showing an example of an arrangement of pressing members.

FIG. 6 is an enlarged cross-sectional view showing a part of the polishing head 7. As shown in FIG. 6, the housing 45A of the carrier 45 has a plurality of stepped holes 66. The plurality of piezoelectric elements 47 are located in these stepped holes 66, respectively. Each piezoelectric element 47 has a stopper protrusion 47*a*. When the stopper protrusion 47*a* contacts a stepped portion 66*a* of the stepped hole 66, the relative positioning of the piezoelectric element 47 with respect to the carrier 45 is achieved.

In the present embodiment, each pressing-force measuring device 57 is arranged in series with the piezoelectric element 47 and the pressing member 54. More specifically, each pressing-force measuring device 57 is arranged between the piezoelectric element 47 and the pressing member 54. The pressing-force measuring devices 57 arranged in this way can separately measure the pressing forces generated respectively by the piezoelectric elements 47. The arrangement of the pressing-force measuring devices 57 is not limited to the embodiment shown in FIG. 6. The pressing-force measuring devices 57 may be arranged between the workpiece W and the pressing members 54, or may be arranged next to the pressing members 54, as long as the pressing-force measuring devices 57 can separately measure the pressing forces generated by the piezoelectric elements 47, respectively.

Each pressing-force measuring device 57 may be configured to convert the measured pressing force [N] into pressure [Pa]. Examples of the pressing-force measuring device 57 include a load cell and a piezoelectric sheet coupled to the plurality of piezoelectric elements 47. The piezoelectric sheet has a plurality of piezoelectric sensors, and each piezoelectric sensor is configured to generate a voltage corresponding to the force applied to the piezoelectric sheet and convert a value of the voltage into a force or a pressure.

End surfaces of the plurality of pressing members 54 constitute pressing surface 54*a* for pressing the workpiece W against the polishing surface 2*a*. The holding member 56 holds the plurality of pressing members 54 so as to allow these pressing members 54 to be movable within a limited range. More specifically, each pressing member 54 has protrusions 54*b* and 54*c* located at upper and lower ends thereof, and further has a body portion 54*d* located between the protrusions 54*b* and 54*c*. The width of the body portion 54*d* is smaller than the widths of the protrusions 54*b* and 54*c*. The holding member 56 has a supporting portion 56*b* that movably supports the pressing member 54 with a certain clearance between the supporting portion 56*b* and the body portion 54*d*. The protrusions 54*b* and 54*c* of each pressing member 54 and the supporting portion 56*b* of the holding member 56 permit each pressing member 54 to move in the vertical direction while limiting the range of the movement of the pressing member 54 in the vertical and horizontal directions by the clearance. The supporting portion 56*b* of the holding member 56 limits the range of movement of the pressing member 54 in the direction perpendicular to a direction of pressing the workpiece W. Since the vertical movement of the pressing member 54 is restricted, the pressing member 54 can prevent an excessive impact or force from being transmitted to the piezoelectric element 47.

When a voltage is applied to the piezoelectric element 47, the piezoelectric element 47 pushes the pressing-force measuring device 57 and the pressing member 54 toward the polishing surface 2*a* of the polishing pad 2, and the pressing member 54 in turn presses a corresponding portion (region) of the workpiece W against the polishing surface 2*a* with a pressing force corresponding to the voltage applied to the piezoelectric element 47.

In the present embodiment, the pressing surfaces 54*a* of the plurality of pressing members 54 are in contact with the back side of the workpiece W. Each pressing surface 54*a* constitutes a workpiece contact surface that contacts the workpiece W. The pressing surface 54*a* may be made of an elastic member, such as silicone rubber. Specific examples of the shape of the pressing surface 54*a* include a regular polygonal shape, a circular shape, a fan shape, an arc shape, an ellipse shape, and a combination of these shapes. Examples of regular polygonal shape having the same distance from the center of the pressing surface 54*a* to vertices include a regular triangular shape, a regular quadrangular shape, and a regular hexagonal shape.

The plurality of pressing members 54 have a plurality of first surfaces 54*e* facing the plurality of piezoelectric elements 47, respectively, and the plurality of pressing surfaces 54*a* as second surfaces for pressing the workpiece W against the polishing surface 2*a*. In the present embodiment, an area of the pressing surface 54*a* of each pressing member 54 is the same as an area of the first surface 54*e*. In one embodiment, the area of the pressing surface 54*a* of each pressing member 54 may be larger than the area of the first surface 54*e*. Changing the shape and area of the pressing surface 54*a* allows for various patterns of the pressing surfaces 54*a*.

FIG. 7 to FIG. 11 are schematic views each showing an example of the arrangement of the pressing members 54. In the example shown in FIG. 7, the plurality of pressing members 54 are arranged in a honeycomb pattern or a staggered pattern. The pressing surface 54*a* of each pressing member 54 is in a shape of regular hexagon. As can be seen from FIG. 7, the regular hexagonal pressing surfaces 54*a* constituting the honeycomb array can minimize a gap between adjacent pressing surfaces 54*a*. Further, the regular hexagon has an advantage that an angle of each vertex is larger than those of the equilateral triangle and the square, and stress concentration is less likely to occur.

Figure 8:
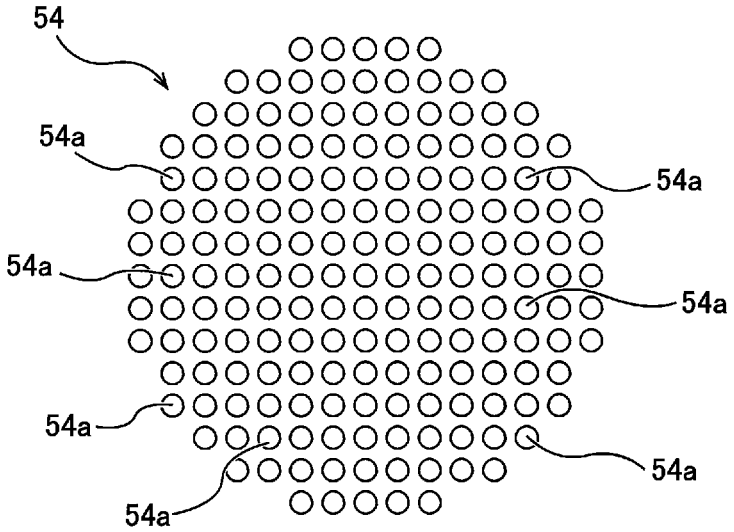
FIG. 8 is a schematic view showing an example of an arrangement of the pressing members.
Figure 9:
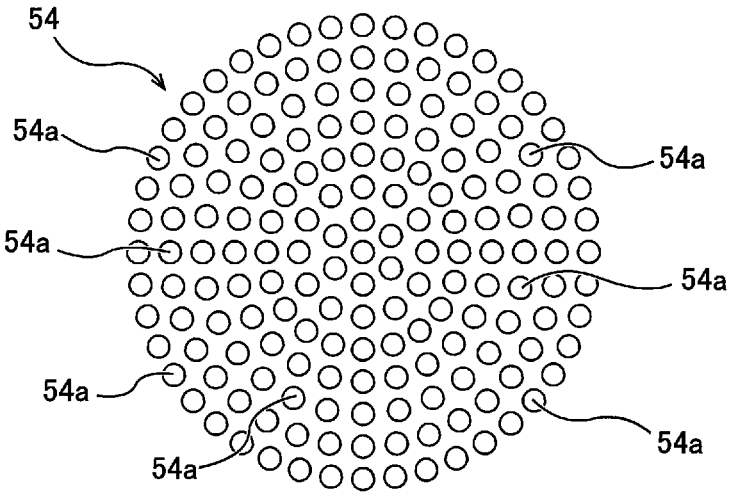
FIG. 9 is a schematic view showing an example of an arrangement of the pressing members.
Figure 10:
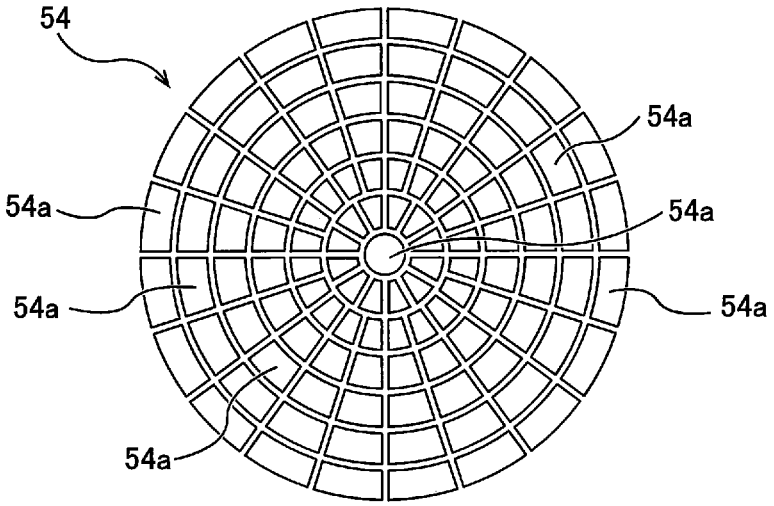
FIG. 10 is a schematic view showing an example of an arrangement of the pressing members.
Figure 11:
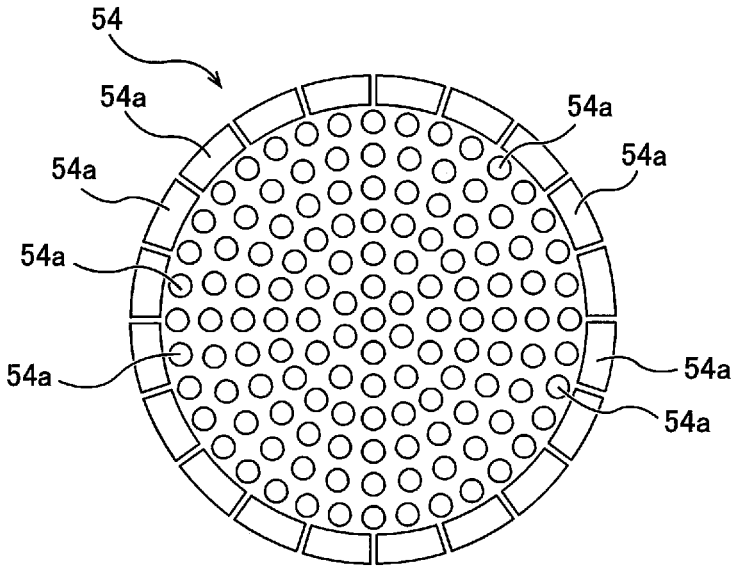
FIG. 11 is a schematic view showing an example of an arrangement of the pressing members.

In the example shown in FIG. 8, the plurality of pressing members 54 are arranged in a grid pattern, and the pressing surface 54*a* of each pressing member 54 has a circular shape. In the example shown in FIG. 9, the plurality of pressing members 54 are arranged concentrically, and the pressing surface 54*a* of each pressing member 54 has a circular shape. In the example shown in FIG. 10, the plurality of pressing members 54 are arranged concentrically, the pressing surface 54*a* of each pressing member 54 has a fan shape, except that a pressing surface 54*a* of a central pressing member 54 has a circular shape. In the example shown in FIG. 11, the plurality of pressing members 54 are arranged concentrically, and pressing surfaces 54*a* of the pressing members 54 have a circular shape and a fan shape. More specifically, pressing members 54 located at the outermost circumference have fan-shaped pressing surface 54*a*, and pressing members 54 located inside the fan-shaped pressing surface 54*a* have circular pressing surfaces 54*a*.

Each pressing member 54 shown in FIG. 7 to FIG. 11 is coupled to each piezoelectric element 47. Therefore, the arrangement of the pressing members 54 shown in FIG. 7 to FIG. 11 is substantially the same as the arrangement of the piezoelectric elements 47. The plurality of piezoelectric elements 47 and the plurality of pressing members 54 are distributed along the radial direction and the circumferential direction of the polishing head 7. Therefore, the polishing head system can precisely control the film-thickness profile of the workpiece W. In particular, the polishing head system can eliminate the variation in film thickness in the circumferential direction of the workpiece W. The arrangement of the piezoelectric elements 47 may be any one or a combination of the grid arrangement, the concentric arrangement, and the staggered arrangement.

In one embodiment, the area of the first surface 54*e* of each pressing member 54 may be larger than the area of the pressing surface 54*a*. In this case, each pressing member 54 may have a plurality of body portions 54*d*. Further, one pressing member 54 may be coupled to at least two piezoelectric elements 47. In one example, at least one of the plurality of pressing members 54 provided in the polishing head 7 may be coupled to two or more piezoelectric elements 47. Such a configuration enables the piezoelectric elements 47 to press one pressing surface 54*a*, and the uniformity of the pressing forces of the pressing surfaces 54*a* is improved.

The operation controller 10 is configured to determine a plurality of instruction values of the voltage necessary to eliminate a difference between a current film-thickness profile and a target film-thickness profile of the workpiece W. The target film-thickness profile of the workpiece W is stored in advance in the memory 10*a* of the operation controller 10. Examples of the current film-thickness profile of the workpiece W include an initial film-thickness profile of the workpiece W before being polished by the polishing apparatus shown in FIG. 1 and a film-thickness profile produced from the film-thickness index values output from the film-thickness sensor 42 when the polishing apparatus shown in FIG. 1 polishes the workpiece W. The initial film-thickness profile may be produced from, for example, film thickness measurement values acquired by a stand-alone film thickness measuring device (not shown) or film thickness measurement values acquired by another polishing apparatus equipped with a film-thickness sensor. The initial film-thickness profile is stored in the memory 10*a* of the operation controller 10.

The operation controller 10 calculates the difference between the current film-thickness profile and the target film-thickness profile of the workpiece W by the arithmetic device 10*b*, and creates a distribution of target polishing amounts for the surface, to be polished, of the workpiece W. Further, the operation controller 10 determines instruction values of the voltage to be applied to the piezoelectric elements 47 in order to achieve the target polishing amounts within a predetermined polishing time, based on the determined distribution of the target polishing amounts. For example, the operation controller 10 creates a distribution of target polishing rates from the distribution of the target polishing amounts and the above predetermined polishing time, and determines the instruction values of the voltage capable of achieving the target polishing rates from a polishing rate correlation data.

After determining the voltage instruction values, the operation controller 10 sends the instruction values to the voltage controller 50*b* of the drive-voltage application device 50. The voltage controller 50*b* issues a changing instruction for the voltage to be applied to each voltage element 47 to the power supply unit 50*a* to adjust the film-thickness profile of the workpiece W. During polishing, the film-thickness profile is adjusted, for example, at regular time intervals or at every rotation cycle of the polishing table 5.

Figure 12:
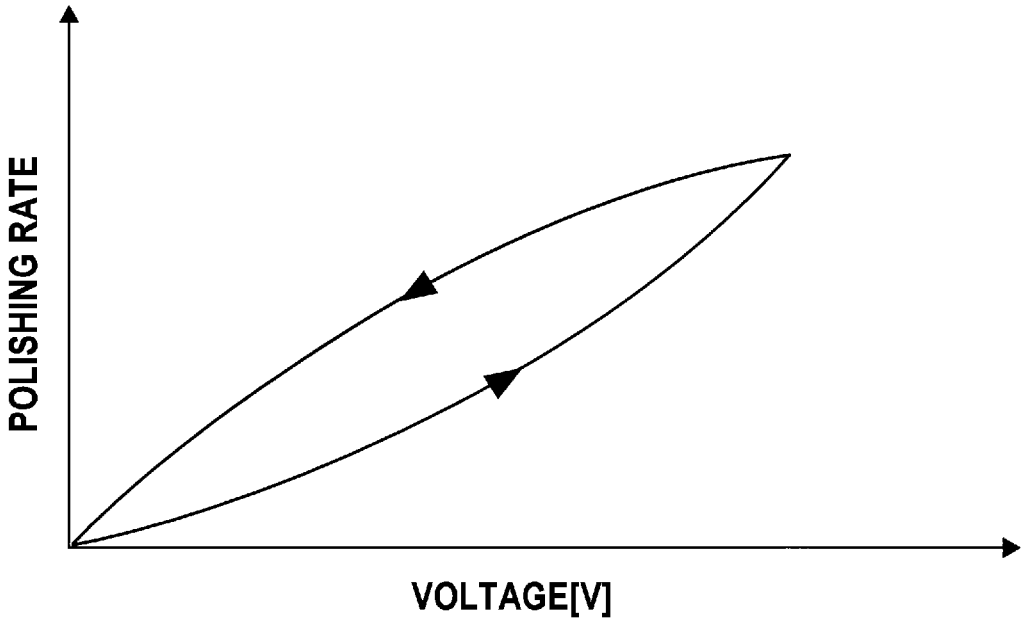
FIG. 12 is a graph showing an example of a polishing-rate data showing a relationship between polishing rate and voltage applied to a piezoelectric element.
Figure 13:
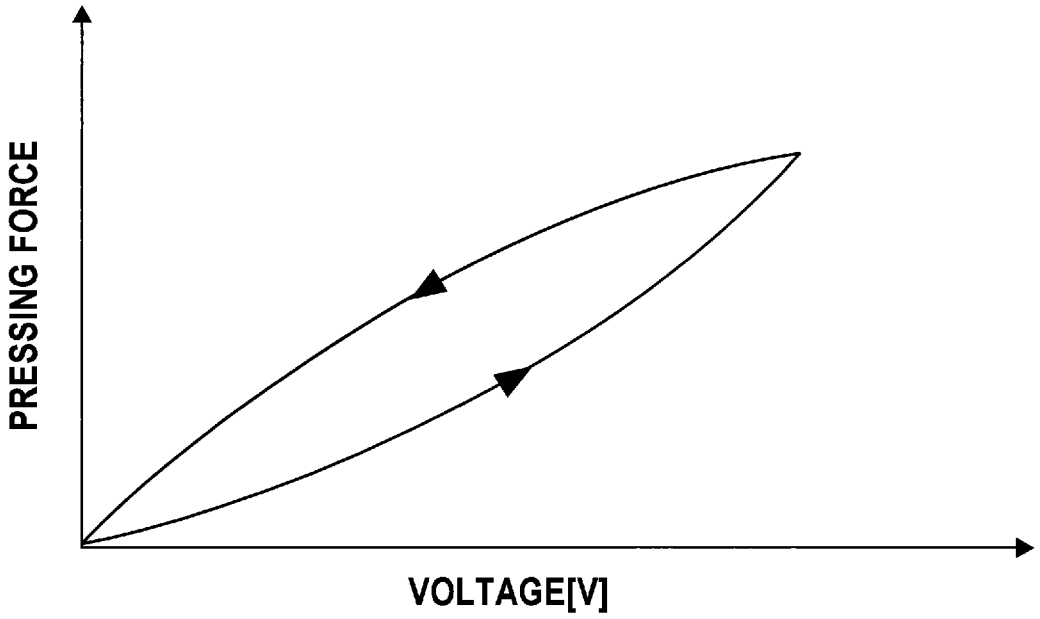
FIG. 13 is a graph showing an example of a pressing-force correlation data showing a relationship between voltage applied to the piezoelectric element and pressing force generated by the piezoelectric element.

FIG. 12 is a graph showing an example of data showing a relationship between the polishing rate and the voltage applied to the piezoelectric element 47, and FIG. 13 is a graph showing an example of data showing a relationship between the voltage applied to the piezoelectric element 47 and the pressing force. The polishing rate is an amount of film removed by polishing per unit time. The amount of film removed by polishing is represented by a film thickness that has been reduced as a result of polishing. The polishing rate is also referred to as a removal rate. The polishing-rate correlation data shown in FIG. 12 is produced from a database including polishing rates obtained from polishing results of other workpieces and voltages applied to the piezoelectric element 47 during polishing of the other workpieces. The polishing-rate correlation data is stored in advance in the memory 10*a*.

Generally, a piezoelectric element has a hysteresis characteristic in terms of displacement amount and pressing force with respect to an applied voltage. Since the polishing rate is proportional to the pressing force, the polishing rate also has a hysteresis characteristic with respect to the voltage. Therefore, when the applied voltage is to be changed during polishing in order to obtain a desired polishing rate, either increasing or decreasing the voltage is also one of parameters for determining the voltage instruction value.

In one embodiment, the operation controller 10 may determine the instruction values of the voltage to be applied to the piezoelectric elements 47 based on the current film-thickness profile of the workpiece W obtained by the film-thickness sensor 42 without producing the distribution of the target polishing amounts. For example, when the target film-thickness profile is a flat film-thickness profile, the operation controller 10 determines an instruction value for applying a voltage higher than a currently-applied voltage by a predetermined amount of change to the piezoelectric element 47 corresponding to a region where the film-thickness index value is large in order to make the current film-thickness profile closer to the flat film-thickness profile. Conversely, the operation controller 10 determines an instruction value for applying a voltage lower than a currently-applied voltage by a predetermined amount of change to other piezoelectric element 47 corresponding to a region where the film-thickness index value is small. The amount of change in the voltage is set as a parameter in advance in the operation controller 10.

The piezoelectric elements 47 are arranged not only in the radial direction of the workpiece W but also in the circumferential direction of the workpiece W. The operation controller 10 determines the instruction values of the voltage required to eliminate the variation in the film thickness of the workpiece W in the circumferential direction, and sends these instruction values to the drive-voltage application device 50. The drive-voltage application device 50 applies the voltages to the corresponding piezoelectric elements 47, so that the variation in the film thickness of the workpiece W in the circumferential direction can be eliminated. In this way, the polishing apparatus including the polishing head system according to the above embodiments can eliminate the variation in the film thickness of the workpiece W in the circumferential direction, and further can achieve the target film-thickness profile.

Next, calibration of the plurality of piezoelectric elements 47 will be described. The calibration of the piezoelectric elements 47 is a process of adjusting the relationship between the voltages applied to the piezoelectric elements 47 and the pressing forces generated by the piezoelectric elements 47. This calibration is performed for the purpose of eliminating the hysteresis of the deformation of the piezoelectric elements 47 and/or the difference in the pressing force caused by a slight difference in installation height of the piezoelectric elements 47.

The calibration is performed as follows. First, with no voltage applied to all the piezoelectric elements 47, the operation controller 10 instructs the elevating mechanism 24 (see FIG. 1) to move the polishing head 7, holding the workpiece W (or a dummy workpiece), toward the polishing table 5 until the workpiece W is brought into contact with the polishing surface 2*a* of the polishing pad 2. While the polishing head 7 is moving toward the polishing table 5, the pressing-force measuring devices 57 measure reaction forces applied from the polishing pad 2 to the piezoelectric elements 47 through the pressing members 54. The elevating mechanism 24 continues to move the polishing head 7 until all the pressing-force measuring devices 57 coupled to all the piezoelectric elements 47 detect the reaction forces from the polishing pad 2.

The operation controller 10 determines a reference height, which is a height of the polishing head 7 at which all the pressing-force measuring devices 57 detect the reaction forces from the polishing pad 2. The reference height is, for example, a height at which all the pressing-force measuring devices 57 first sense the pressing forces. The height of the polishing head 7 is a relative height of the polishing head 7 with respect to the polishing table 5. The operation controller 10 can calculate the height of the polishing head 7 from a pitch of the ball-screw mechanism 32 and the number of rotations of the servomotor 38. The reference height of the polishing head 7 is stored in the memory 10*a*. When all the pressing-force measuring devices 57 detect the reaction forces from the polishing pad 2, the operation controller 10 instructs the elevating mechanism 24 to stop moving the polishing head 7 toward the polishing table 5. Further, the operation controller 10 stores in the memory 10*a* the measured values of the reaction forces output from all the pressing-force measuring devices 57 when the movement of the polishing head 7 is stopped.

In order to eliminate an influence of a variation in height of the polishing surface 2*a* of the polishing pad 2, the above-mentioned determination of the reference height of the polishing head 7 and the measuring of the reaction force may be performed plural times at different regions on the polishing surface 2*a*. In this case, an average of a plurality of reference heights and an average of a plurality of measured values of the reaction force obtained at the different regions on the polishing surface 2*a* are used as the reference height of the polishing head 7 and the measurement value of the reaction force.

The operation controller 10 determines voltage correction values from the pressing-force correlation data based on the distribution of the reaction forces applied to the piezoelectric elements 47 measured at the reference height by the pressing-force measuring devices 57. The voltage correction values are calibration voltages corresponding to the piezoelectric elements 47, respectively. The voltage correction values are stored in the memory 10*a*. The pressing-force correlation data shown in FIG. 13 is produced from a database including measured values of the pressing force obtained during polishing of other workpiece and voltages applied to the piezoelectric element 47 during polishing of the other workpiece. The pressing-force correlation data is stored in advance in the memory 10*a*.

When the workpiece W is to be polished, the operation controller 10 instructs the elevating mechanism 24 to position the polishing head 7 at the reference height. The operation controller 10 determines tentative instruction values of the voltage to be applied to the piezoelectric elements 47, determines the instruction values by correcting these tentative instruction values using the corresponding voltage correction values, and transmits the determined instruction values to the voltage controller 50*b* of the drive-voltage application device 50. The voltage controller 50*b* instructs the power supply unit 50*a* to apply voltages to the corresponding piezoelectric elements 47 according to the instruction values, so that the power supply unit 50*a* applies the voltages to the piezoelectric elements 47.

In another example, the calibration may be performed as follows. First, with a predetermined voltage applied to all the piezoelectric elements 47, the operation controller 10 instructs the elevating mechanism 24 (see FIG. 1) to move the polishing head 7, holding the workpiece W (or a dummy workpiece), toward the polishing table 5 until the workpiece W is brought into contact with the polishing surface 2*a* of the polishing pad 2. While the polishing head 7 is moving toward the polishing table 5, the pressing-force measuring devices 57 measure the reaction forces applied from the polishing pad 2 to the piezoelectric elements 47 through the pressing members 54. The elevating mechanism 24 continues to move the polishing head 7 until all the pressing-force measuring devices 57 coupled to all the piezoelectric elements 47 detect the reaction forces from the polishing pad 2.

The operation controller 10 determines a reference height, which is a height of the polishing head 7 at which all the pressing-force measuring devices 57 detect the reaction forces from the polishing pad 2. The reference height of the polishing head 7 is stored in the memory 10*a*. When all the pressing-force measuring devices 57 detect the reaction forces from the polishing pad 2, the operation controller 10 instructs the elevating mechanism 24 to stop moving the polishing head 7 toward the polishing table 5.

The arithmetic device 10*b* of the operation controller 10 determines an average or a median of the measured values of the reaction forces output from the pressing-force measuring devices 57 when the movement of the polishing head 7 is stopped. With the polishing head 7 maintained at the reference height, the operation controller 10 instructs the drive-voltage application device 50 to adjust the voltages applied to the piezoelectric elements 47 until the measured values output from all the pressing-force measuring devices 57 reach the above-described average or median. The operation controller 10 determines voltages applied respectively to the piezoelectric elements 47 when the measured values output from all the pressing-force measuring devices 57 reach the above-described average or median, and stores the determined voltages as voltage correction values in the memory 10*a*.

In order to eliminate an influence of a variation in height of the polishing surface 2*a* of the polishing pad 2, the above-mentioned determination of the reference height of the polishing head 7 and the determination of the voltage correction values may be performed plural times at different regions on the polishing surface 2*a*. In this case, an average of reference heights and an average of voltage correction values obtained at different regions on the polishing surface 2*a* can be used as the reference height and the voltage correction value of the polishing head 7.

When the workpiece W is to be polished, the operation controller 10 instructs the elevating mechanism 24 to position the polishing head 7 at the reference height. The operation controller 10 determines tentative instruction values of the voltage to be applied to the piezoelectric elements 47, determines the instruction values by correcting these tentative instruction values using the corresponding voltage correction values, and transmits the determined instruction values to the voltage controller 50*b* of the drive-voltage application device 50. The voltage controller 50*b* instructs the power supply unit 50*a* to apply voltages to the corresponding piezoelectric elements 47 according to the instruction values, so that the power supply unit 50*a* applies the voltages to the piezoelectric elements 47.

In one embodiment, the reference height of the polishing head 7 may be obtained as discussed below, and polishing may then be started without performing the calibration of the piezoelectric elements 47. First, with no voltage applied to all the piezoelectric elements 47, the operation controller 10 instructs the elevating mechanism 24 (see FIG. 1) to move the polishing head 7, holding the workpiece W (or a dummy workpiece), toward the polishing table 5, until the workpiece W is brought into contact with the polishing surface 2*a* of the polishing pad 2. While the polishing head 7 is moving toward the polishing table 5, the pressing-force measuring devices 57 measure the reaction forces applied from the polishing pad 2 to the piezoelectric elements 47 through the pressing members 54. The elevating mechanism 24 continues to move the polishing head 7 until all the pressing-force measuring devices 57 coupled to all the piezoelectric elements 47 detect the reaction forces from the polishing pad 2.

The operation controller 10 determines a reference height, which is a height of the polishing head 7 at which all the pressing-force measuring devices 57 detect the reaction forces from the polishing pad 2. The reference height of the polishing head 7 is stored in the memory 10*a*. In order to eliminate an influence of a variation in height of the polishing surface 2*a* of the polishing pad 2, the above-mentioned determination of the reference height of the polishing head 7 may be performed plural times at different regions on the polishing surface 2*a*. In this case, an average of a plurality of reference heights obtained at different regions on the polishing surface 2*a* can be used as the reference height of the polishing head 7.

When the workpiece W is to be polished, the operation controller 10 instructs the elevating mechanism 24 to position the polishing head 7 at the reference height. The operation controller 10 produces a film-thickness profile as shown in FIG. 4 from the film-thickness index values output from the film-thickness sensor 42 (see FIG. 1), determines the instruction values of the voltage to be applied to the piezoelectric elements 47 based on the film-thickness profile, and transmits the instruction values to the voltage controller 50*b* of the drive-voltage application device 50. The voltage controller 50*b* instructs the power supply unit 50*a* to apply voltages to the corresponding piezoelectric elements 47 according to the instruction values, so that the power supply unit 50*a* applies the voltages to the piezoelectric elements 47.

In each of the above examples, measuring of the reaction forces from the polishing pad 2 may be performed by the piezoelectric elements 47, instead of the pressing-force measuring devices 57. While each piezoelectric element 47 functions as an actuator for pressing the workpiece W against the polishing pad 2, each piezoelectric element 47 also functions as a device for measuring a force applied to the piezoelectric element 47. In this case, the drive-voltage application device 50 has both a voltage application circuit and a sensing circuit. The pressing-force measuring devices 57 may be omitted.

Figure 14:
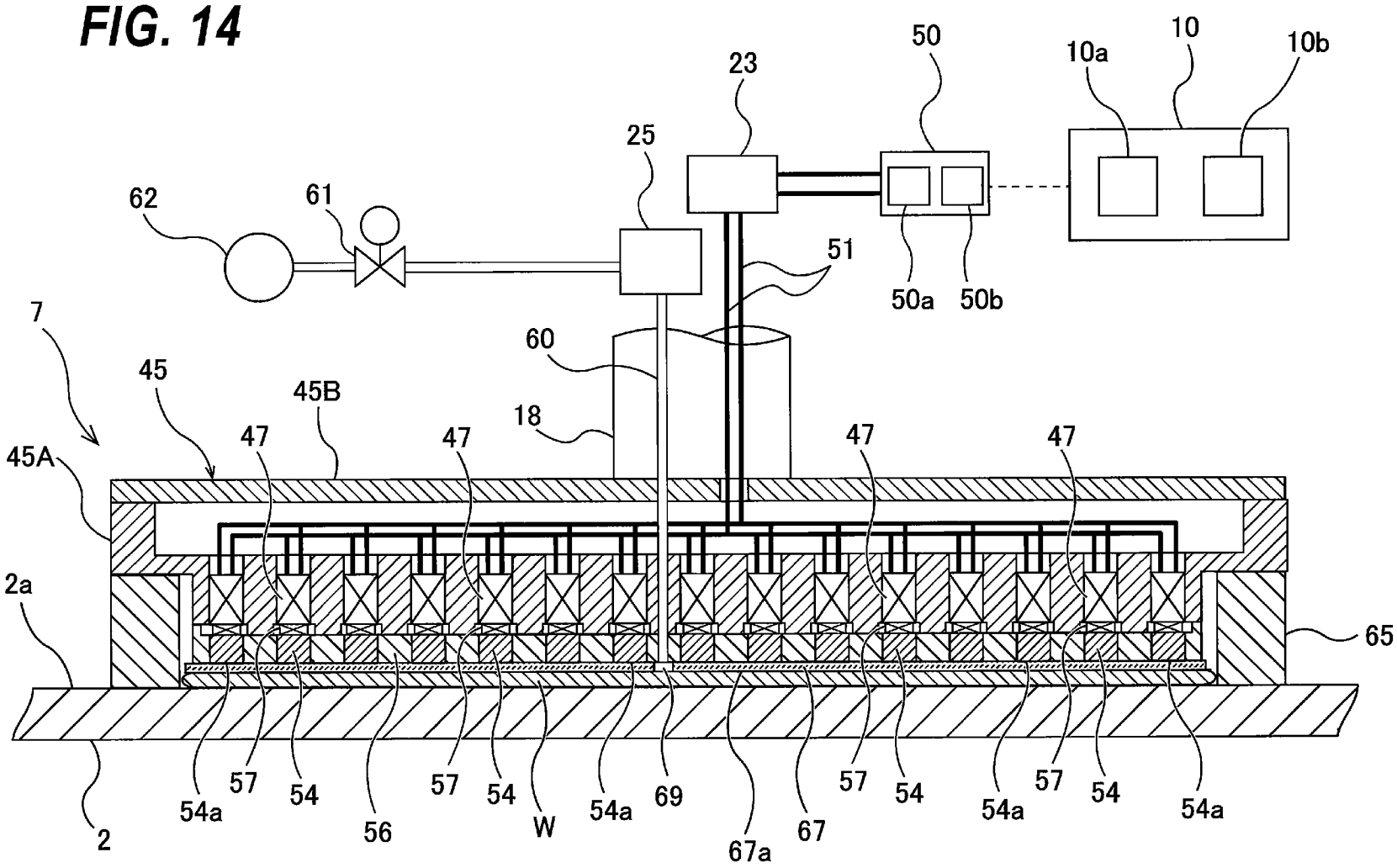
FIG. 14 is a cross-sectional view showing another embodiment of the polishing head system.

FIG. 14 is a cross-sectional view showing another embodiment of the polishing head system. Configurations and operations of this embodiment, which will not be particularly described, are the same as those of any of the embodiments described with reference to FIG. 1 to FIG. 13, and duplicated descriptions will be omitted. The polishing head 7 of the embodiment shown in FIG. 14 has an elastic membrane 67 in contact with the pressing surfaces 54*a* of the pressing members 54. The elastic membrane 67 covers the pressing surfaces 54*a* of all the pressing members 54 and an end surface (or a lower surface in this embodiment) of the holding member 56. An inner surface of the elastic membrane 67 is in contact with the pressing members 54, and an outer surface of the elastic membrane 67 constitutes a workpiece contact surface 67*a* that contacts the workpiece W. Vacuum line 60 communicates with the workpiece contact surface 67*a* of the polishing head 7. More specifically, the vacuum line 60 communicates with a through-hole 69 formed in the elastic membrane 67 forming the workpiece contact surface 67*a*. When the vacuum line 60 forms a vacuum in the through-hole 69, the workpiece W is held on the elastic membrane 67 by vacuum suction (i.e., held by the polishing head 7).

The elastic membrane 67 is made of a flexible and highly chemical resistant material, such as silicone rubber or EPDM. The elastic membrane 67 has a role in suppressing a damage which may be caused by direct contact of the back surface of the workpiece W with the pressing surfaces 54*a* of the pressing members 54 and the holding member 56, and a role in transmitting a rotating torque to the workpiece W more efficiently during rotation of the polishing head 7. It is desirable that the elastic membrane 67 has a Young's modulus of 10 MPa or less and a thickness of 10 mm or less.

According to this embodiment, the pressing members 54 do not directly contact the workpiece W. The pressing members 54 press the workpiece W through the elastic membrane 67 against the polishing surface 2*a* of the polishing pad 2. The elastic membrane 67 can prevent a liquid, such as a polishing liquid or a cleaning liquid, from entering the inside of the polishing head 7, and in particular, can prevent the liquid from contacting the piezoelectric elements 47.

Further, the elastic membrane 67 can prevent the workpiece W from rotating relative to the polishing head 7 during polishing of the workpiece W. If the workpiece W rotates relative to the polishing head 7, the positional relationship between the circumferential position of the workpiece W and the piezoelectric elements 47 of the polishing head 7 changes. As a result, an optimum voltage cannot be applied to the intended piezoelectric element 47, and the variation in film thickness along the circumferential direction of the workpiece W cannot be eliminated. According to the present embodiment, the elastic membrane 67 is in intimate contact with the back side of the workpiece W during polishing of the workpiece W, and can therefore prevent the workpiece W from rotating relative to the polishing head 7.

Figure 15:
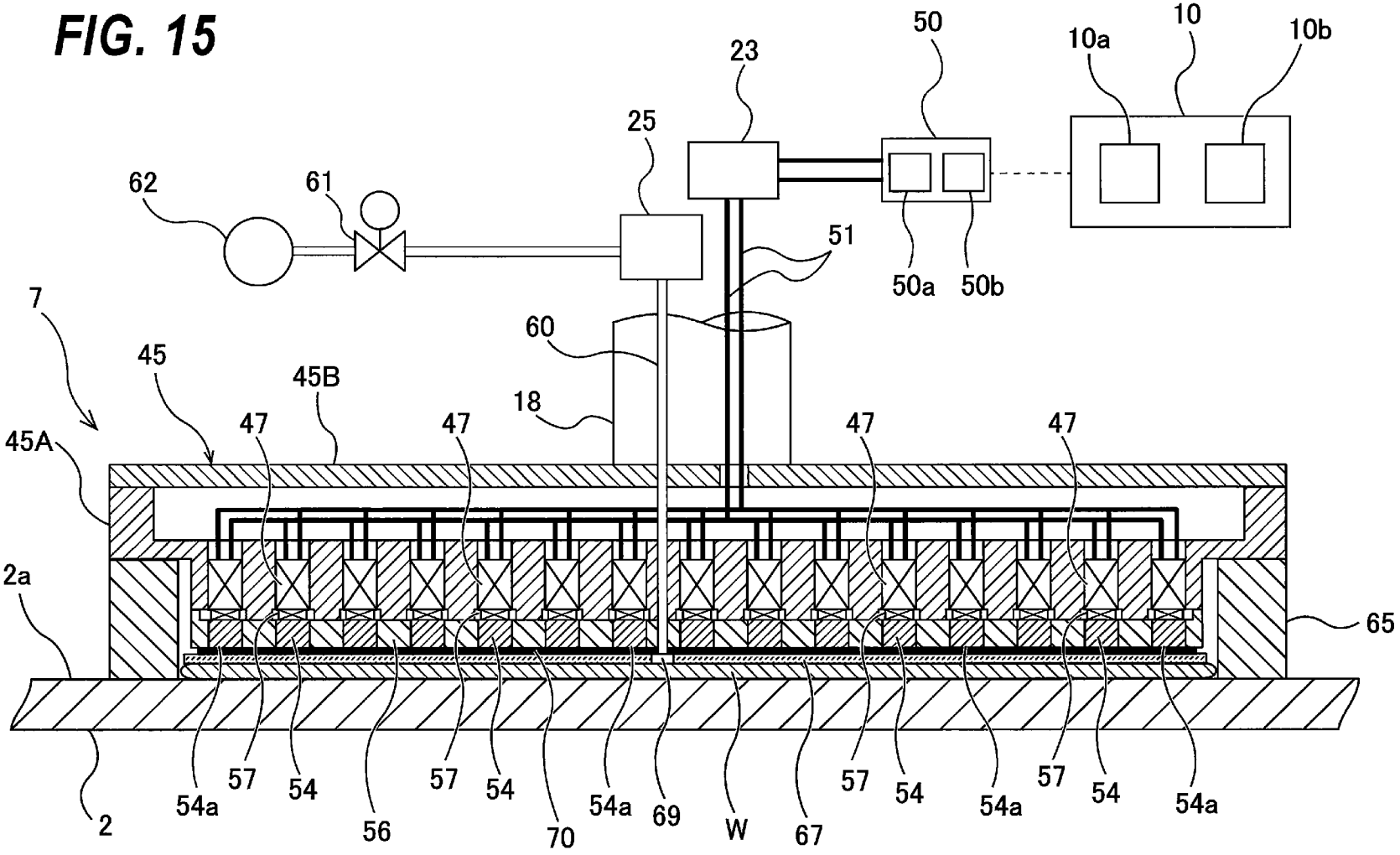
FIG. 15 is a cross-sectional view showing still another embodiment of the polishing head system.

As shown in FIG. 15, a plate 70 may be arranged between the pressing surfaces 54*a* of the plurality of pressing members 54 and the elastic membrane 67. The plate 70 is made of a metal, such as stainless steel, or a hard material, such as a hard resin. The vacuum line 60 extends through the plate 70 and communicates with the through-hole 69. The plate 70 can disperse the pressing forces generated by the plurality of piezoelectric elements 47, and can apply a linearly changing pressing force to the workpiece W. In this figure, one plate 70 is provided for the piezoelectric elements 47 arranged in the polishing head 7, while the plate 70 may be a plurality of plates.

Figure 16:
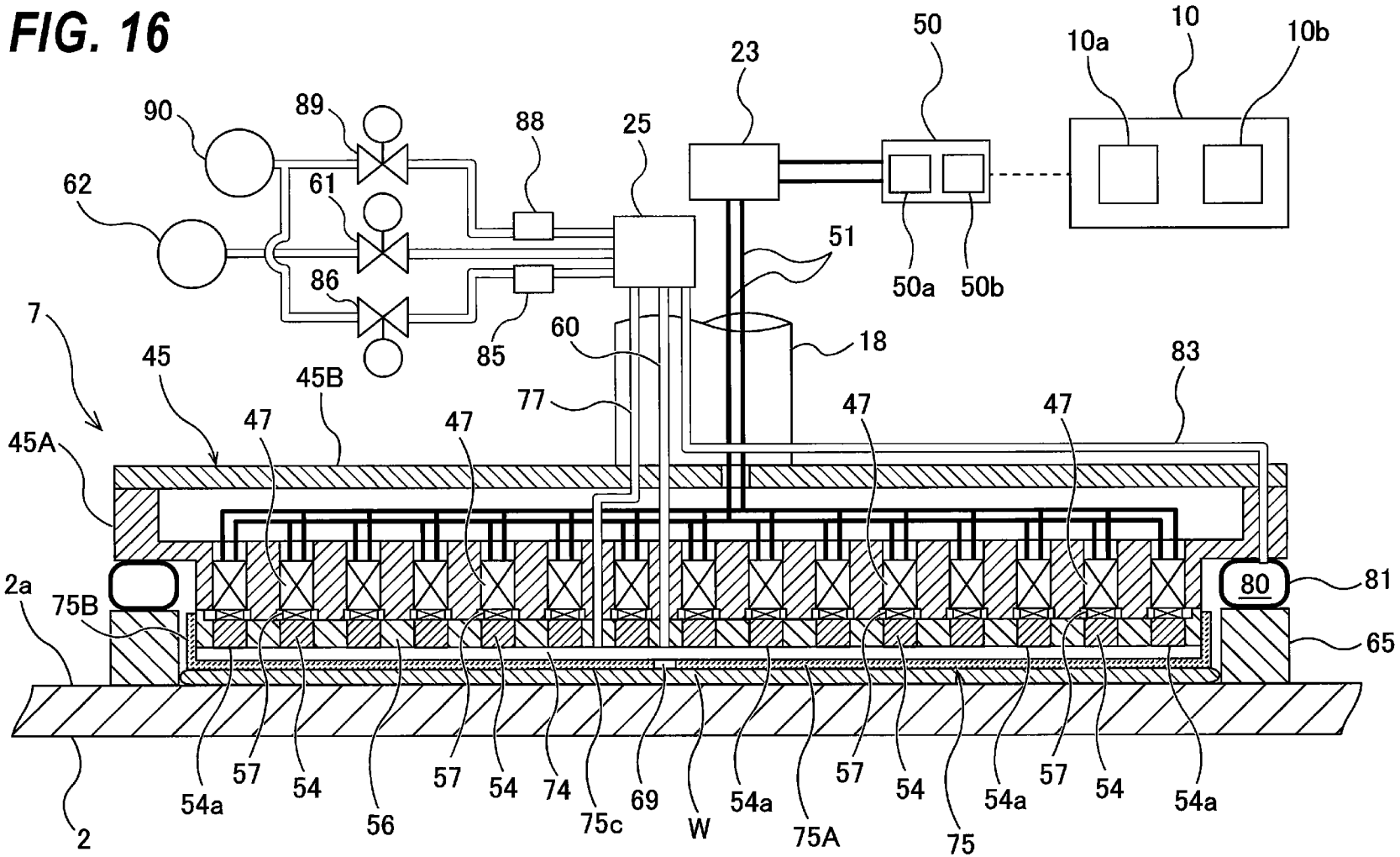
FIG. 16 is a cross-sectional view showing still another embodiment of the polishing head system.

FIG. 16 is a cross-sectional view showing still another embodiment of the polishing head system. Configurations and operations of this embodiment, which will not be particularly described, are the same as those of any of the embodiments described with reference to FIG. 1 to FIG. 15, and duplicated descriptions will be omitted. The polishing head system of the embodiment shown in FIG. 16 further includes a first elastic membrane 75 for forming a first pressure chamber 74 in the polishing head 7, a first compressed-gas supply line 77 communicating with the first pressure chamber 74, a second elastic membrane 81 for forming a second pressure chamber 80 in the polishing head 7, and a second compressed-gas supply line 83 communicating with the second pressure chamber 80. The first elastic membrane 75 includes a contact portion 75A that covers the pressing surfaces 54*a* of all the pressing members 54 and an end surface (or a lower surface in this embodiment) 56*a* of the holding member 56, and a side wall 75B connected to an edge of the contact portion 75A. The side wall 75B is held by the holding member 56. In one embodiment, the side wall 75B may be held by the carrier 45.

The first pressure chamber 74 is located between the plurality of pressing members 54 and the first elastic membrane 75. An inner surface of the contact portion 75A forms the first pressure chamber 74, and an outer surface of the contact portion 75A constitutes a workpiece contact surface 75*c* that contacts the workpiece W. The vacuum line 60 communicates with the workpiece contact surface 75*c* of the polishing head 7. More specifically, the vacuum line 60 communicates with a through-hole 69 formed in the contact portion 75A forming the workpiece contact surface 75*c*. When the vacuum line 60 forms a vacuum in the through-hole 69, the workpiece W is held on the contact portion 75A of the elastic membrane (i.e., held by the polishing head 7) by vacuum suction.

The second pressure chamber 80 is formed between the carrier 45 and the retainer ring 65. The second elastic membrane 81 forming the second pressure chamber 80 is coupled to both the carrier 45 and the retainer ring 65. The second elastic membrane 81 has an annular shape extending along the entire circumference of the retainer ring 65. The second elastic membrane 81 is arranged so as to surround the plurality of piezoelectric elements 47. Both the first elastic membrane 75 and the second elastic membrane 81 are made of a flexible and highly chemical resistant material, such as silicone rubber or EPDM.

The polishing head system includes a first pressure regulator 85 and a first on-off valve 86 which are attached to the first compressed-gas supply line 77, and a second pressure regulator 88 and a second on-off valve 89 which are attached to the second compressed-gas supply line 83. The first on-off valve 86 is an actuator-driven on-off valve, such as an electric-motor-operated valve, a solenoid valve, or an air-operated valve. The first on-off valve 86 is coupled to the operation controller 10, and the operation of the first on-off valve 86 is controlled by the operation controller 10. Similarly, the second on-off valve 89 is an actuator-driven on-off valve, such as an electric-motor-operated valve, a solenoid valve, or an air-operated valve. The second on-off valve 89 is coupled to the operation controller 10, and the operation of the second on-off valve 89 is controlled by the operation controller 10.

The first compressed-gas supply line 77 extends through the carrier 45 and the holding member 56, and one end of the first compressed-gas supply line 77 is open in the end surface (or the lower surface in this embodiment) 56*a* of the holding member 56. The first compressed-gas supply line 77 extends via the rotary joint 25, the first pressure regulator 85, and the first on-off valve 86. The other end of the first compressed-gas supply line 77 is coupled to a compressed-gas supply source 90. The second compressed-gas supply line 83 extends via the rotary joint 25, the second pressure regulator 88, and the second on-off valve 89. One end of the second compressed-gas supply line 83 is coupled to the second pressure chamber 80, and the other end of the second compressed-gas supply line 83 is coupled to the compressed-gas supply source 90.

The compressed-gas supply source 90 supplies a compressed gas composed of air, an inert gas (for example, a nitrogen gas), or the like to the first compressed-gas supply line 77 and the second compressed-gas supply line 83. The compressed-gas supply source 90 may be a compressed-gas supply source as a utility equipment installed in a factory where the polishing apparatus is installed, or may be a pump configured to deliver a compressed gas. When the operation controller 10 opens the first on-off valve 86, the compressed gas is supplied into the polishing head 7 through the first compressed-gas supply line 77. As a result, the side wall 75B of the first elastic membrane 75 expands and the first pressure chamber 74 is formed between the pressing members 54 and the first elastic membrane 75, while the contact portion 75A of the first elastic membrane 75 separates from the pressing members 54. The contact portion 75A of the first elastic membrane 75 has substantially the same size and shape as those of the workpiece W. Therefore, the pressure of the compressed gas in the first pressure chamber 74 is applied to the entire workpiece W through the contact portion 75A of the first elastic membrane 75. The entire surface of the workpiece W is pressed against the polishing surface 2*a* of the polishing pad 2 with a uniform pressure.

The pressure of the compressed gas in the first pressure chamber 74 is regulated by the first pressure regulator 85. The first pressure regulator 85 is coupled to the operation controller 10, so that the operation of the first pressure regulator 85 (i.e., the pressure of the compressed gas in the first pressure chamber 74) is controlled by the operation controller 10. More specifically, the operation controller 10 sends a first pressure instruction value to the first pressure regulator 85, and the first pressure regulator 85 operates so as to maintain the pressure in the first pressure chamber 74 at the first pressure instruction value.

Figure 17:
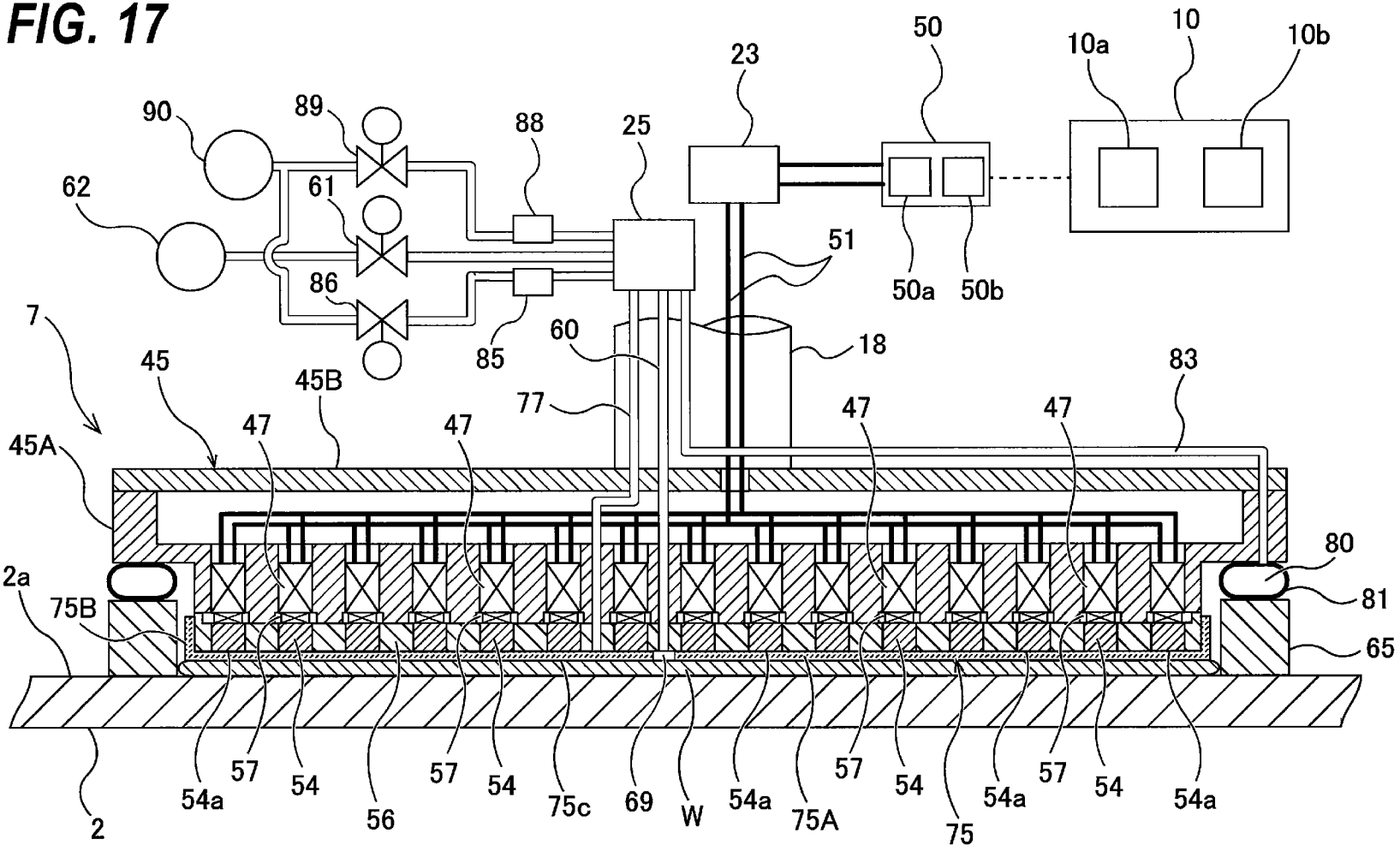
FIG. 17 is a diagram showing a state in which a first pressure chamber shown in FIG. 16 has disappeared and a contact portion of the first elastic membrane is in contact with pressing surfaces of the plurality of pressing members.

When the operation controller 10 closes the first on-off valve 86 to stop the supply of the compressed gas to the first pressure chamber 74 and opens the vacuum valve 61, a vacuum is formed in the first pressure chamber 74 by the vacuum line 60. As a result, as shown in FIG. 17, the first pressure chamber 74 disappears, and the contact portion 75A of the first elastic membrane 75 contacts the pressing surfaces 54*a* of the plurality of pressing members 54. When the voltages are applied to the piezoelectric elements 47 with the contact portion 75A of the first elastic membrane 75 in contact with the pressing surfaces 54*a* of the plurality of pressing members 54, the piezoelectric elements 47 can press the workpiece W against the polishing surface 2*a* of the polishing pad 2 via the pressing members 54 and the contact portion 75A of the first elastic membrane 75. In this manner, this embodiment can realize both uniform pressing of the workpiece W by the compressed gas and pressing of the workpiece W with different forces by the plurality of piezoelectric elements 47. In the state of FIG. 17, the workpiece W moves upward because the first pressure chamber 74 disappears. In that case, the height of the polishing head 7 may be adjusted by the elevating mechanism 24.

When the operation controller 10 opens the second on-off valve 89, the compressed gas is supplied into the second pressure chamber 80. As a result, the pressure of the compressed gas in the second pressure chamber 80 is applied to the retainer ring 65 through the second elastic membrane 81, and the retainer ring 65 presses the polishing surface 2*a* of the polishing pad 2. The second pressure chamber 80 extends along the entire circumference of the retainer ring 65. Therefore, the pressure of the compressed gas in the second pressure chamber 80 is applied to the entire retainer ring 65 through the second elastic membrane 81, and the retainer ring 65 is pressed with a uniform pressure against the polishing surface 2*a* of the polishing pad 2.

The pressure of the compressed gas in the second pressure chamber 80 is regulated by the second pressure regulator 88. The second pressure regulator 88 is coupled to the operation controller 10, so that the operation of the second pressure regulator 88 (i.e., the pressure of the compressed gas in the second pressure chamber 80) is controlled by the operation controller 10. More specifically, the operation controller 10 sends a second pressure instruction value to the second pressure regulator 88, and the second pressure regulator 88 operates so as to maintain the pressure in the second pressure chamber 80 at the second pressure instruction value.

The polishing apparatus including the polishing head system according to the embodiments described with reference to FIG. 16 and FIG. 17 can polish the workpiece W as follows.

First, while the polishing table 5 and the polishing head 7 shown in FIG. 1 are rotated independently, the polishing liquid is supplied to the polishing surface 2*a* of the polishing pad 2 by the polishing-liquid supply nozzle 8. The polishing head 7 is positioned at the predetermined height, and the operation controller 10 opens the first on-off valve 86 and the second on-off valve 89 to supply the compressed gas to the first pressure chamber 74 and the second pressure chamber 80 through the first compressed-gas supply line 77 and the second compressed-gas supply line 83, respectively (see FIG. 16). The pressure in the first pressure chamber 74 and the pressure in the second pressure chamber 80 are regulated by the first pressure regulator 85 and the second pressure regulator 88, respectively.

The compressed gas in the first pressure chamber 74 presses the workpiece W against the polishing surface 2*a* of the polishing pad 2 through the first elastic membrane 75, while the compressed gas in the second pressure chamber 80 presses the retainer ring 65 against the polishing surface 2*a* of the polishing pad 2 through the second elastic membrane 81. When a predetermined polishing time has elapsed, or when the film-thickness index value output from the film-thickness sensor 42 (see FIG. 1) reaches a target value, such as a target remaining film thickness, the operation controller 10 closes the first on-off valve 86 to stop the supply of the compressed gas to the first pressure chamber 74. Further, the operation controller 10 opens the vacuum valve 61 to form a vacuum in the first pressure chamber 74 to vanish the first pressure chamber 74, so that the contact portion 75A of the first elastic membrane 75 is brought into contact with the pressing surfaces 54*a* of the pressing members 54 (see FIG. 17). At the same time, the operation controller 10 instructs the second pressure regulator 88 to reduce the pressure in the second pressure chamber 80. At this time, the height of the polishing head 7 may be adjusted by the elevating mechanism 24.

The operation controller 10 instructs the drive-voltage application device 50 to apply the voltages to the piezoelectric elements 47, respectively, to thereby cause the piezoelectric elements 47 to generate the pressing forces. The pressing forces are applied to the workpiece W through the pressing members 54 and the contact portion 75A of the first elastic membrane 75. The workpiece W is pressed against the polishing surface 2*a* of the polishing pad 2 by the pressing forces generated by the piezoelectric elements 47. Similar to the embodiments described above, the operation controller 10 determines instruction values of the voltages required to eliminate the difference between the current film-thickness profile and the target film-thickness profile of the workpiece W, and sends these instruction values to the drive-voltage application device 50. The drive-voltage application device 50 applies the voltages to the corresponding piezoelectric elements 47 according to the instruction values. Since the pressing force can vary for each of the piezoelectric elements 47, a plurality of portions (regions) of the workpiece W are pressed with different pressing forces against the polishing surface 2*a*.

As described above, the polishing apparatus of the present embodiment can perform two-step polishing comprising uniform polishing of the workpiece W and polishing for adjusting the film-thickness profile of the workpiece W.

Although only the first pressure chamber 74 is provided for pressurizing the workpiece W in FIG. 17, concentric pressure chambers may be provided, and compressed-gas supply lines may be provided for these pressure chambers, respectively. According to the embodiment, the film-thickness profile is adjusted by the compressed-gas pressurization, and then the film-thickness profile is adjusted highly precisely by the piezoelectric elements 47, so that a more uniform film-thickness profile can be obtained.

Figure 18:
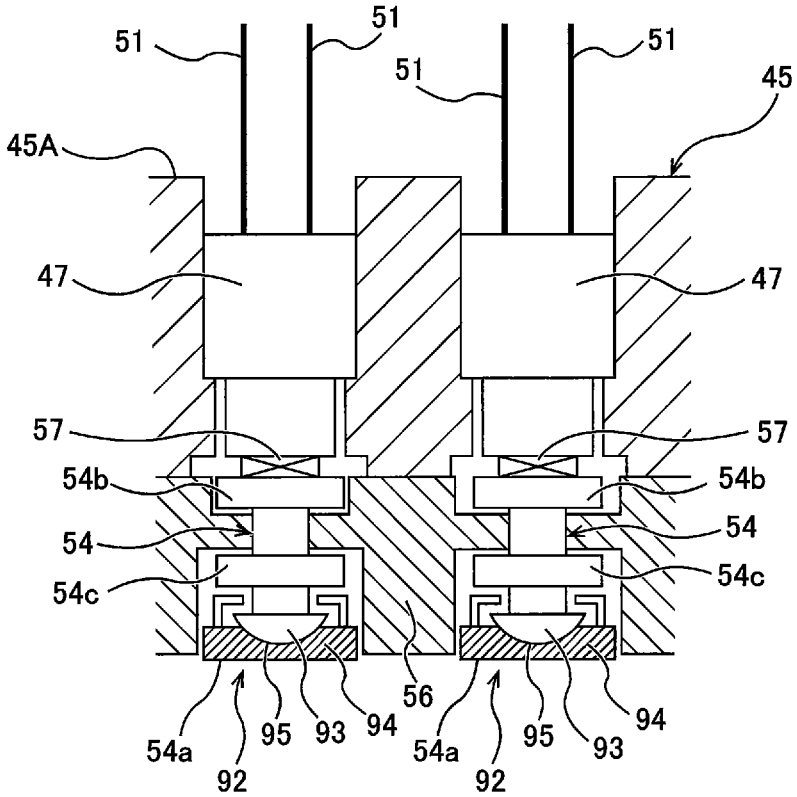
FIG. 18 is a cross-sectional view showing a part of the polishing head having a gimbal mechanism.

FIG. 18 is a cross-sectional view showing a part of the polishing head 7 according to still another embodiment. Configurations and operations of this embodiment, which will not be particularly described, are the same as those of any of the embodiments described with reference to FIG. 1 to FIG. 17, and duplicated descriptions will be omitted. As shown in FIG. 18, each pressing member 54 includes a gimbal mechanism 92 having a movable member 94 that is tiltable in all directions. Although only two pressing members 54 are depicted in FIG. 18, the other pressing members 54 also have gimbal mechanisms 92, respectively. Each gimbal mechanism 92 has a spherical bearing 93 fixed to the protrusion 54*c*, and a movable member 94 in contact with the spherical bearing 93. The movable member 94 has a concave surface 95 receiving the spherical bearing 93, and further has the pressing surface 54*a* for pressing the workpiece W. While the concave surface 95 is in smooth sliding contact with the spherical bearing 93, the entire movable member 94 can tilt in all directions.

The gimbal mechanism 92 of the present embodiment allows each pressing member 54 to follow the surface of the workpiece W. When the plurality of pressing members 54 press the workpiece W against the polishing pad 2 with different pressing forces, the surface of the workpiece W may undulate. Even in such a case, the gimbal mechanism 92 shown in FIG. 18 allows each movable member 94 to tilt so as to follow the surface of the workpiece W, and allows each pressing member 54 to press the workpiece W appropriately.

Figure 19:
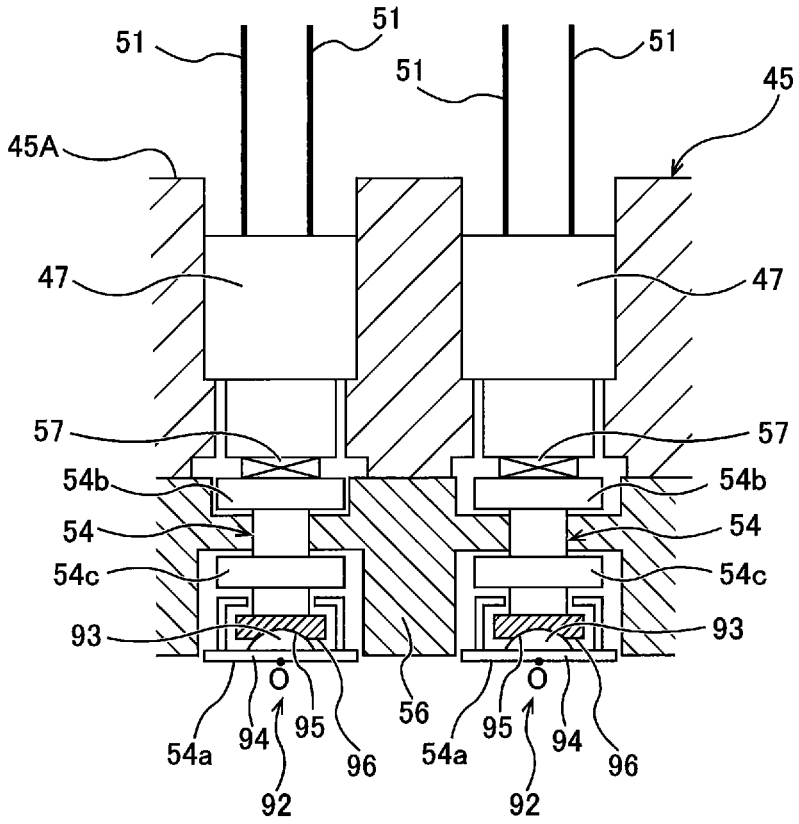
FIG. 19 is a schematic view showing another configuration example of the gimbal mechanism.

FIG. 19 is a schematic view showing another configuration example of the gimbal mechanism 92. Each gimbal mechanism 92 has a support member 96 fixed to the protrusion 54*c*. The support member 96 has a concave surface 95 that receives the spherical bearing 93. The spherical bearing 93 is integral with the movable member 94. The spherical bearing 93 may be fixed to the movable member 94, or the spherical bearing 93 and the movable member 94 may be an integral structure. The movable member 94 has the pressing surface 54*a* for pressing the workpiece W.

The movable member 94 having the pressing surface 54*a* tilts together with the spherical bearing 93. The center of curvature O of the spherical bearing 93 is located on the pressing surface 54*a* of the movable member 94 or located near the pressing surface 54*a*. The spherical bearing 93 and the movable member 94 can tilt around the center of curvature O. The gimbal mechanism 92 of the present embodiment has the center of curvature O that is closer to the polishing surface 2*a* as compared with the gimbal mechanism 92 of FIG. 18, so that each movable member 94 can more easily follow the surface of the workpiece W, while the movable member 94 is prevented from tilting more than necessary.

Figure 20:
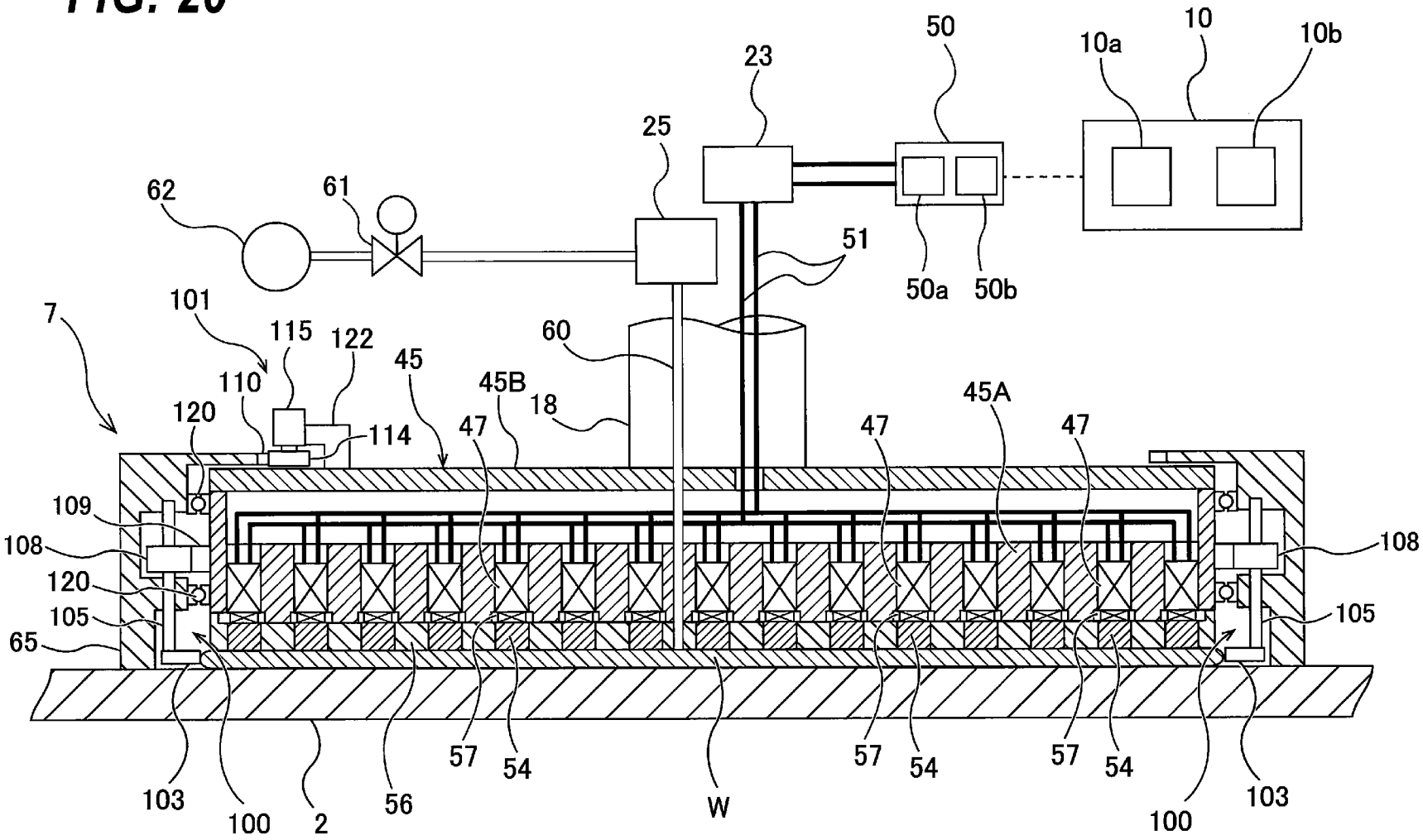
FIG. 20 is a cross-sectional view showing still another embodiment of the polishing head system.

FIG. 20 is a cross-sectional view showing still another embodiment of the polishing head system. Configurations and operations of this embodiment, which will not be particularly described, are the same as those of any of the embodiments described with reference to FIG. 1 to FIG. 19, and duplicated descriptions will be omitted.

The polishing head system according to the embodiment shown in FIG. 20 includes at least three workpiece chuck mechanisms 100 configured to hold the edge of the workpiece W, and a chuck drive device 101 configured to drive these workpiece chuck mechanisms 100. The workpiece chuck mechanisms 100 are fixed to the retainer ring 65. The workpiece chuck mechanisms 100 are arranged outwardly of the edge of the workpiece W in the polishing head 7.

Each workpiece chuck mechanism 100 includes a contact member 103 arranged to contact the edge of the workpiece W, a shaft 105 fixed to the contact member 103, and a first gear 108 fixed to the shaft 105. The chuck drive device 101 includes a second gear 109 that meshes with the first gear 108, a third gear 110 fixed to the retainer ring 65, a fourth gear 114 that meshes with the third gear 110, and an electric motor 115 coupled to the fourth gear 114. The contact member 103 is located at the same height as the workpiece W, and is slightly separated from the polishing surface 2*a* of the polishing pad 2. The shaft 105 is rotatably held by the retainer ring 65. The contact member 103 is coupled to the end of the shaft 105 and is rotatable together with the shaft 105.

The second gear 109 is fixed to the outer surface of the carrier 45 and has a shape surrounding the carrier 45. The inner surface of the retainer ring 65 is rotatably supported by bearings 120. More specifically, an inner race of each bearing 120 is fixed to the outer surface of the carrier 45, and an outer race of each bearing 120 is fixed to the inner surface of the retainer ring 65. Therefore, the retainer ring 65 and the plurality of workpiece chuck mechanisms 100 can rotate relative to the carrier 45. The electric motor 115 is fixed to the carrier 45 via a bracket 122.

The electric motor 115 is coupled to the operation controller 10, so that the operation of the electric motor 115 is controlled by the operation controller 10. When the operation controller 10 operates the electric motor 115, the fourth gear 114 coupled to the electric motor 115 rotates, and the rotation is transmitted to the third gear 110, whereby the retainer ring 65 and the plurality of workpiece chuck mechanisms 100 rotate around the central axis of the polishing head 7. The first gear 108 rotates together with the retainer ring 65 while the first gear 108 meshes with the second gear 109, to thereby rotate the shaft 105 and the contact member 103 until the contact member 103 contacts the edge of the workpiece W.

Figure 21:
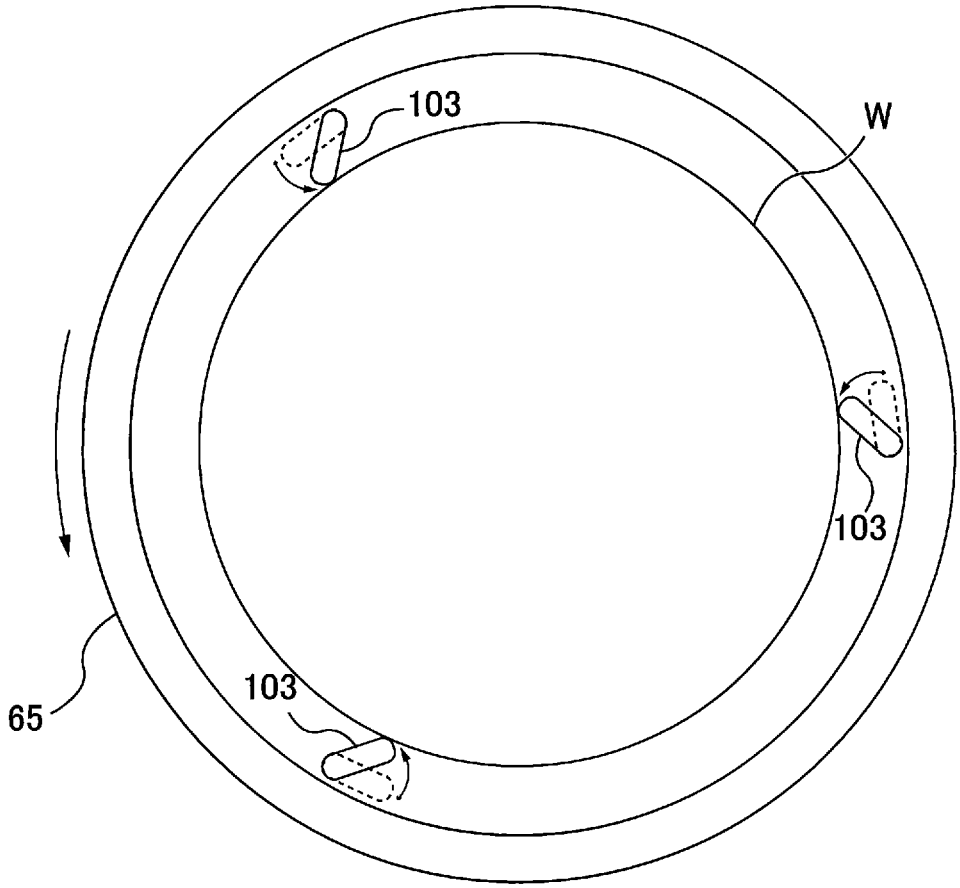
FIG. 21 is a schematic view showing a manner in which contact members shown in FIG. 20 are brought into contact with a workpiece.

FIG. 21 is a schematic view showing the contact members 103 shown in FIG. 20 contacting the workpiece W. Although three contact members 103 are arranged in this figure, the present invention is not limited to this embodiment. In one embodiment, four or more contact members 103 (i.e., four or more workpiece chuck mechanisms 100) may be provided. As shown in FIG. 21, when the retainer ring 65 rotates in one direction, the contact members 103 rotate in a direction approaching the center of the polishing head 7, until the contact members 103 are brought into contact with the edge of the workpiece W. The plurality of contact members 103 rotate synchronously and push the workpiece W toward the center of the polishing head 7. By such contact between the contact members 103 and the workpiece W, centering of the workpiece W is achieved and the position of the workpiece W in the radial direction is fixed. When the fixation by the contact members 103 is to be released, the retainer ring 65 is rotated in the opposite direction by reversing the electric motor 115. As a result, the contact members 103 rotate in the direction away from the center of the polishing head 7, and the contact members 103 separate from the edge of the workpiece W.

The workpiece chuck mechanisms 100 and the chuck drive device 101 described with reference to FIG. 20 and FIG. 21 can prevent the workpiece W from rotating relative to the polishing head 7 during polishing of the workpiece W, and can prevent the workpiece W from moving in the radial direction relative to the polishing head 7. Therefore, during polishing of the workpiece W, the relative positions of the piezoelectric elements 47 with respect to the workpiece W are fixed. As a result, the piezoelectric elements 47 can apply the pressing forces to the intended portions (regions) of the workpiece W, and can form the target film-thickness profile.

Figure 22:
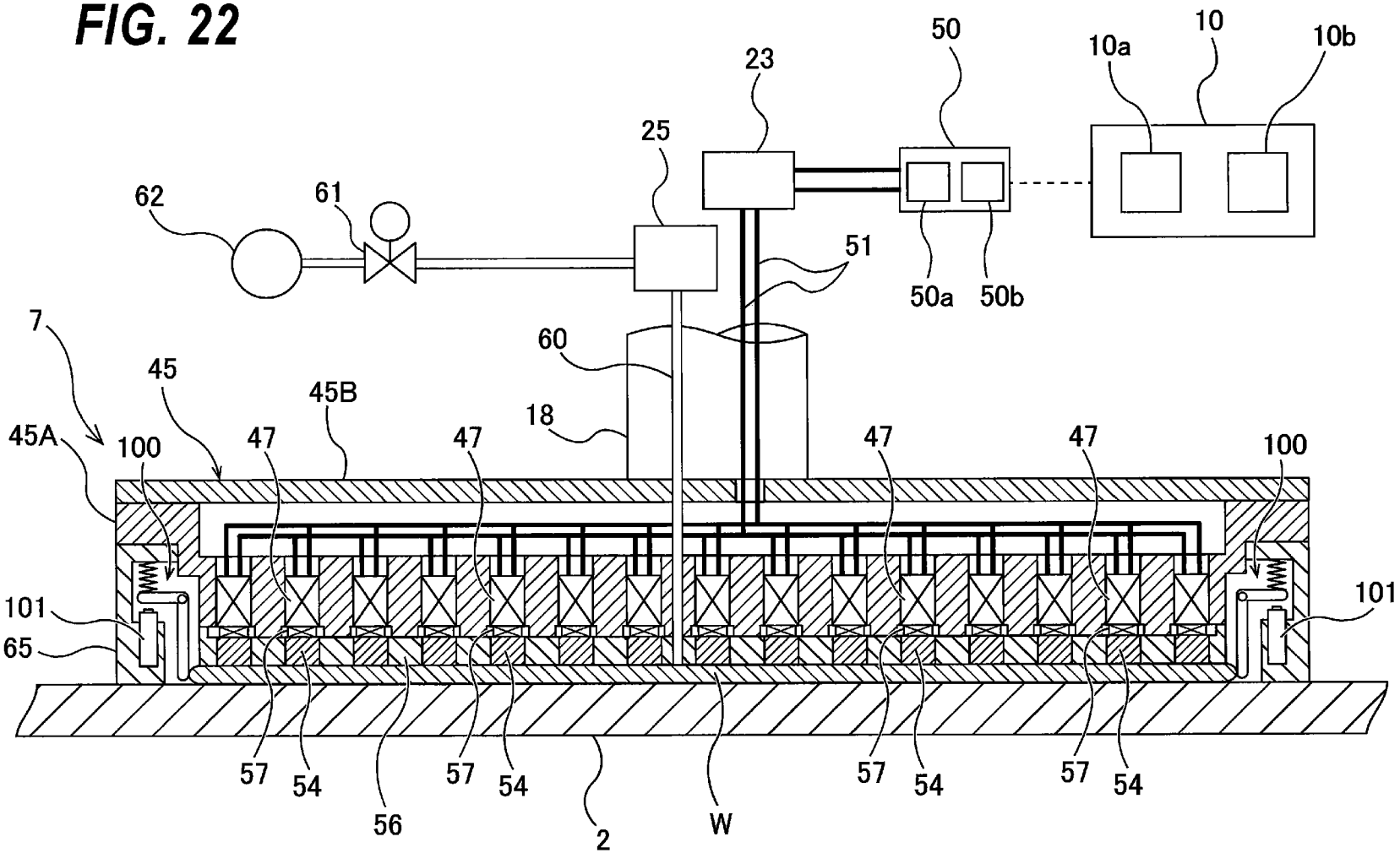
FIG. 22 is a cross-sectional view showing another embodiment of a workpiece chuck mechanism and a chuck drive device.

FIG. 22 is a cross-sectional view showing another embodiment of the workpiece chuck mechanisms 100 and the chuck drive device 101. Configurations and operations of this embodiment, which will not be particularly described, are the same as those of any of the embodiments described with reference to FIG. 1 to FIG. 21, and duplicated descriptions will be omitted.

The polishing head system according to the embodiment shown in FIG. 22 includes at least three workpiece chuck mechanisms 100 configured to hold the edge of the workpiece W and at least three chuck drive devices 101 configured to drive these workpiece chuck mechanisms 100, respectively. The workpiece chuck mechanisms 100 and the chuck drive devices 101 are fixed to the retainer ring 65. The workpiece chuck mechanisms 100 and the chuck drive devices 101 are arranged around the center of the polishing head 7.

Figure 23:
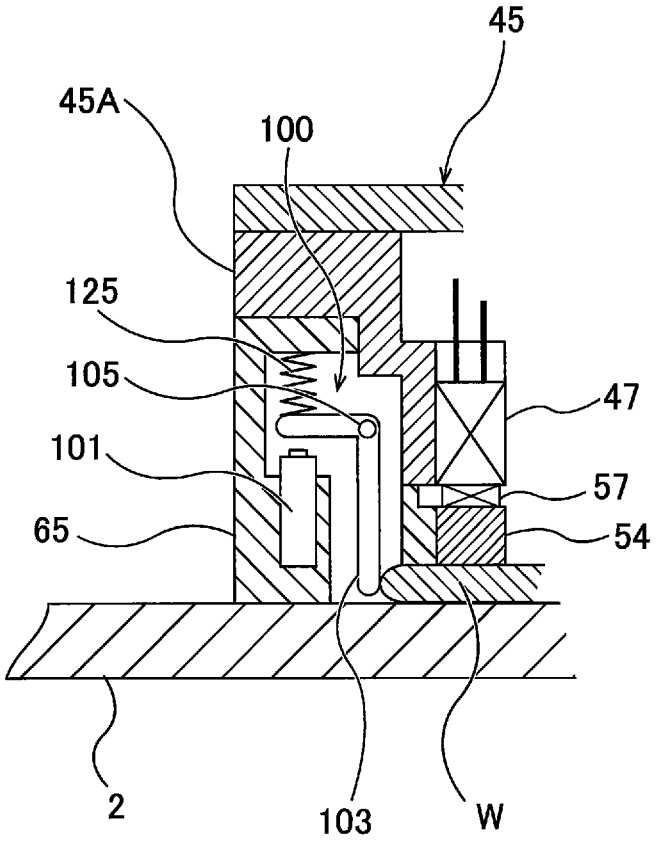
FIG. 23 is an enlarged cross-sectional view of the workpiece chuck mechanism and the chuck drive device shown in FIG. 22.
Figure 24:
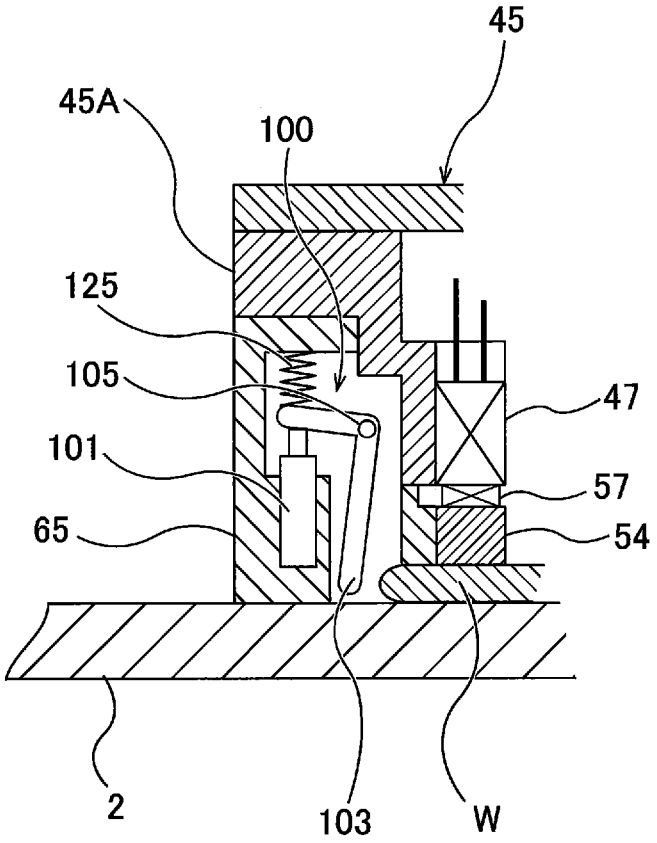
FIG. 24 is an enlarged cross-sectional view of the workpiece chuck mechanism and the chuck drive device shown in FIG. 22.

FIGS. 23 and 24 are enlarged cross-sectional views of the workpiece chuck mechanism 100 and the chuck drive device 101 shown in FIG. 22. Each workpiece chuck mechanism 100 includes a contact member 103 arranged to contact the edge of the workpiece W, a shaft 105 that rotatably supports the contact member 103, and a spring 125 configured to press the contact member 103 to rotate the contact member 103 around the shaft 105. One end of the contact member 103 is located at the same height as the workpiece W, and is slightly separated from the polishing surface 2*a* of the polishing pad 2. The other end of the contact member 103 is in contact with the spring 125. The shaft 105 is held by the retainer ring 65. The spring 125 is arranged so as to rotate the contact member 103 in a direction in which one end of the contact member 103 approaches the center of the polishing head 7.

The chuck drive device 101 is composed of an actuator, such as an air cylinder, a piezoelectric element, or an electric cylinder. The chuck drive device 101 is fixed to the retainer ring 65, as well as the workpiece chuck mechanism 100. As shown in FIG. 24, the chuck drive device 101 is configured to rotate the contact member 103 in a direction in which one end of the contact member 103 moves away from the center of the polishing head 7. More specifically, the chuck driving device 101 pushes the contact member 103 against the force of the spring 125 to rotate the contact member 103 in a direction in which one end of the contact member 103 is separated from the edge of the workpiece W.

Each chuck drive device 101 is coupled to the operation controller 10, so that the operation of each chuck drive device 101 is controlled by the operation controller 10. As shown in FIG. 23, when the chuck drive device 101 is separated from the contact member 103, the spring 125 applies a force to the contact member 103 to rotate the contact member 103 in one direction to bring the contact member 103 into contact with the edge of the workpiece W. As shown in FIG. 24, when the chuck driving device 101 pushes the contact member 103, the contact member 103 rotates in the opposite direction, so that the contact member 103 is separated from the edge of the workpiece W.

The operation controller 10 operates the plurality of chuck drive devices 101 simultaneously. The plurality of contact members 103 rotate synchronously and push the workpiece W toward the center of the polishing head 7. By such contact between the contact members 103 and the workpiece W, centering of the workpiece W is achieved and the position of the workpiece W in the radial direction is fixed.

The workpiece chuck mechanisms 100 and the chuck drive devices 101 described with reference to FIG. 22 to FIG. 24 can prevent the workpiece W from rotating relative to the polishing head 7 during polishing of the workpiece W, and can prevent the workpiece W from moving in the radial direction relative to the polishing head 7. Therefore, during polishing of the workpiece W, the relative positions of the piezoelectric elements 47 with respect to the workpiece W are fixed. As a result, the piezoelectric elements 47 can apply the pressing forces to the intended portions (regions) of the workpiece W, and can form the target film-thickness profile.

According to the embodiment shown in FIG. 20 and FIG. 24, the polishing head 7 can hold the workpiece W by the workpiece chuck mechanisms 100. Therefore, the vacuum line 60 for holding the workpiece W by the vacuum suction may be omitted.

Figure 25:
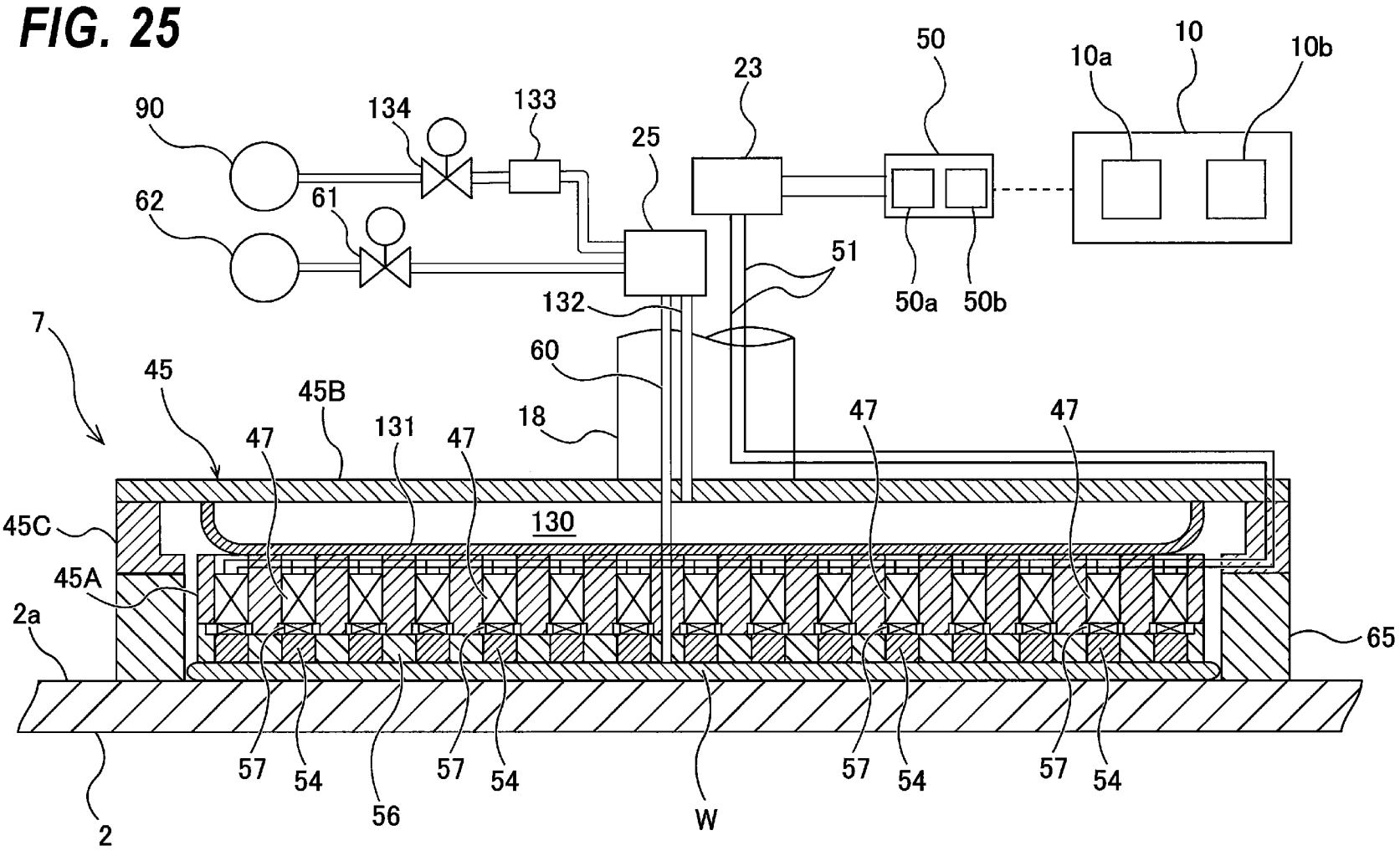
FIG. 25 is a cross-sectional view showing still another embodiment of the polishing head system.

FIG. 25 is a cross-sectional view showing still another embodiment of the polishing head 7. Configurations and operations of this embodiment, which will not be particularly described, are the same as those of any of the embodiments described with reference to FIG. 1 to FIG. 24, and duplicated descriptions will be omitted.

As shown in FIG. 25, the polishing head system includes an elastic sheet 131 forming a pressure chamber 130 between the flange 45B of the carrier 45 and the plurality of piezoelectric elements 47, a compressed-gas supply line 132 communicating with the pressure chamber 130, and a pressure regulator 133 and an on-off valve 134 attached to the compressed-gas supply line 132. The carrier 45 has the flange 45B, the side portion 45C detachably attached to the flange 45B, and the housing 45A that holds the plurality of piezoelectric elements 47. The housing 45A is separated from the flange 45B and the side portion 45C, and is movable relative to the flange 45B and the side portion 45C.

The elastic sheet 131 is arranged inside the carrier 45. More specifically, the elastic sheet 131 is located between the flange 45B and the housing 45A of the carrier 45 (i.e., between the flange 45B and the plurality of piezoelectric elements 47). In this embodiment, the elastic sheet 131 is located above the piezoelectric elements 47. The elastic sheet 131 has a shape that forms the pressure chamber 130 inside the elastic sheet 131. The piezoelectric elements 47 are located between the elastic sheet 131 and the pressing members 54.

The compressed-gas supply line 132 extends via the rotary joint 25, the pressure regulator 133, and the on-off valve 134. The compressed-gas supply line 132 extends through the flange 45B of the carrier 45. One end of the compressed-gas supply line 132 communicates with the pressure chamber 130. The other end of the compressed-gas supply line 132 is coupled to the compressed-gas supply source 90. The compressed-gas supply source 90 supplies a compressed gas composed of air, an inert gas (for example, a nitrogen gas), or the like to the compressed-gas supply line 132.

The on-off valve 134 is an actuator-driven on-off valve, such as an electric-motor-operated valve, a solenoid valve, or an air-operated valve. The on-off valve 134 is coupled to the operation controller 10, so that the operation of the on-off valve 134 is controlled by the operation controller 10. The pressure of the compressed gas in the pressure chamber 130 is regulated by the pressure regulator 133. The pressure regulator 133 is coupled to the operation controller 10, so that the operation of the pressure regulator 133 (i.e., the pressure of the compressed gas in the pressure chamber 130) is controlled by the operation controller 10. More specifically, the operation controller 10 sends a pressure instruction value to the pressure regulator 133, and the pressure regulator 133 operates so as to maintain the pressure in the pressure chamber 130 at the pressure instruction value.

When the operation controller 10 opens the on-off valve 134, the compressed gas is supplied into the pressure chamber 130 through the compressed-gas supply line 132. The pressure of the compressed gas in the pressure chamber 130 pushes the plurality of piezoelectric elements 47 and the housing 45A through the elastic sheet 131, so that the piezoelectric elements 47, the pressing-force measuring devices 57, the pressing members 54, and the holding member 56 are moved away from the flange 45B of the carrier 45 (i.e., toward the polishing pad 2 and the polishing table 5). The pressure of the compressed gas in the pressure chamber 130 is applied to the entire workpiece W through the piezoelectric elements 47 and the holding member 56.

According to the present embodiment, while the pressure of the compressed gas in the pressure chamber 130 is applied to the entire workpiece W, the piezoelectric elements 47 can apply different pressing forces to a plurality of portions (regions) of the workpiece W and the pressing-force measuring devices 57 can measure these pressing forces. The polishing head system according to the present embodiment can achieve the target film-thickness profile of the workpiece W while increasing the overall polishing rate of the workpiece W.

Figure 26:
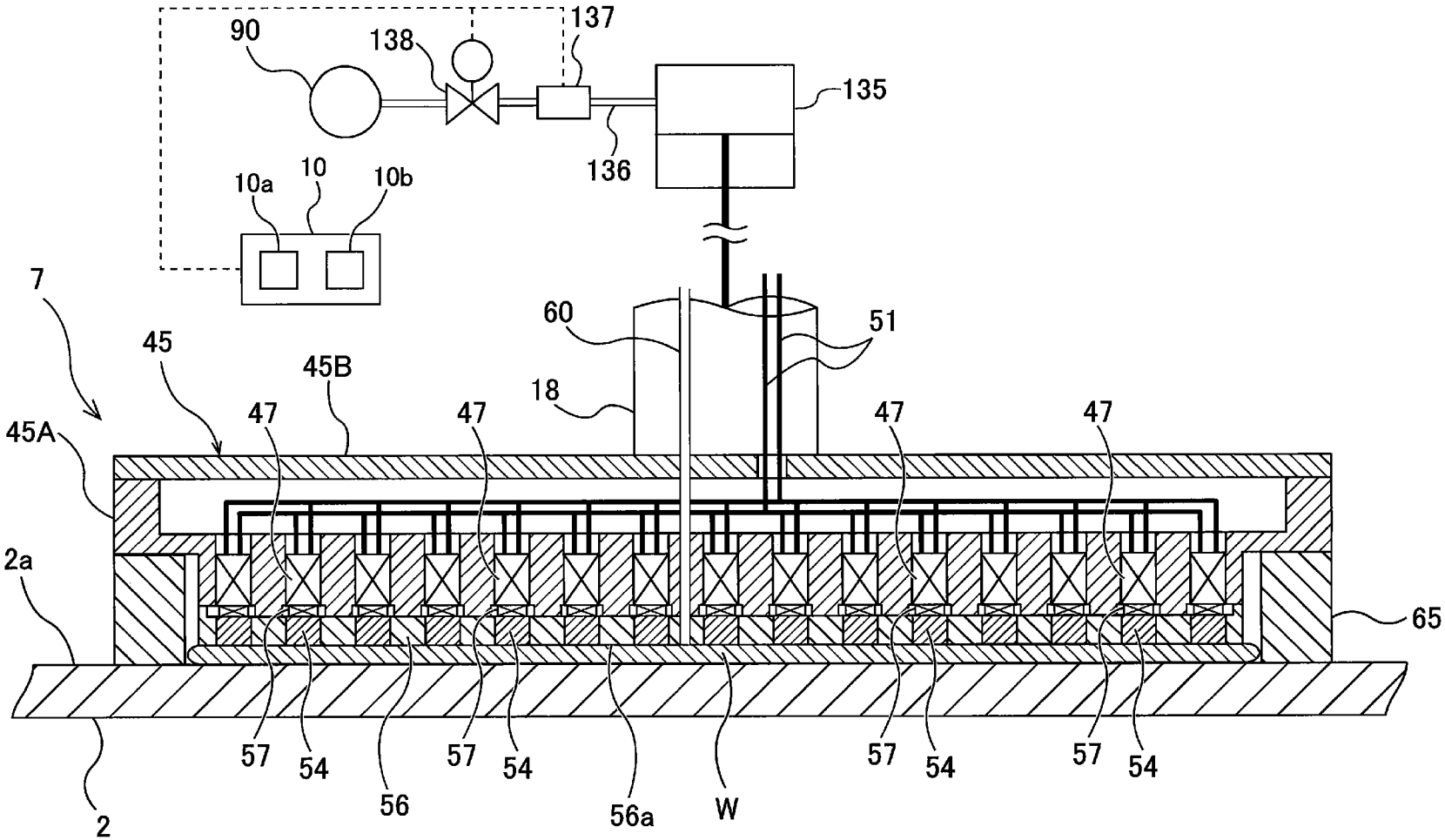
FIG. 26 is a cross-sectional view showing still another embodiment of the polishing head system.

FIG. 26 is a cross-sectional view showing still another embodiment of the polishing head system. Configurations and operations of this embodiment, which will not be particularly described, are the same as those of any of the embodiments described with reference to FIG. 1 to FIG. 25, and duplicated descriptions will be omitted.

In the present embodiment, the polishing-head shaft 18 is coupled to an air cylinder 135, instead of the elevating mechanism 24 described with reference to FIG. 1. The air cylinder 135 is fixed to the polishing-head oscillation arm 16 (see FIG. 1). The air cylinder 135 is coupled to a compressed-gas supply line 136. More specifically, one end of the compressed-gas supply line 136 is coupled to the air cylinder 135, and the other end of the compressed-gas supply line 136 is coupled to the compressed-gas supply source 90. The compressed-gas supply source 90 supplies a compressed gas composed of air, an inert gas (for example, a nitrogen gas), or the like to the compressed-gas supply line 136.

A pressure regulator 137 and an on-off valve 138 are attached to the compressed-gas supply line 136. The on-off valve 138 is an actuator-driven on-off valve, such as an electric-motor-operated valve, a solenoid valve, or an air-operated valve. The on-off valve 138 is coupled to the operation controller 10, so that the operation of the on-off valve 138 is controlled by the operation controller 10. The pressure of the compressed gas in the air cylinder 135 is regulated by the pressure regulator 137. The pressure regulator 137 is coupled to the operation controller 10, so that the operation of the pressure regulator 137 (i.e., the pressure of the compressed gas in the air cylinder 135) is controlled by the operation controller 10.

When the operation controller 10 opens the on-off valve 138, the compressed gas is supplied into the air cylinder 135 through the compressed-gas supply line 136. The air cylinder 135 moves the entire polishing head 7 through the polishing-head shaft 18 toward the polishing pad 2 and the polishing table 5. The force generated by the air cylinder 135 is applied from the polishing head 7 to the entire workpiece W.

According to the present embodiment, while the air cylinder 135 applies the force to the entire workpiece W, the piezoelectric elements 47 can apply different pressing forces to a plurality of portions (regions) of the workpiece W and the pressing-force measuring devices 57 can measure these pressing forces. The polishing head system according to the present embodiment can achieve the target film-thickness profile of the workpiece W while increasing the overall polishing rate of the workpiece W.

Figure 27:
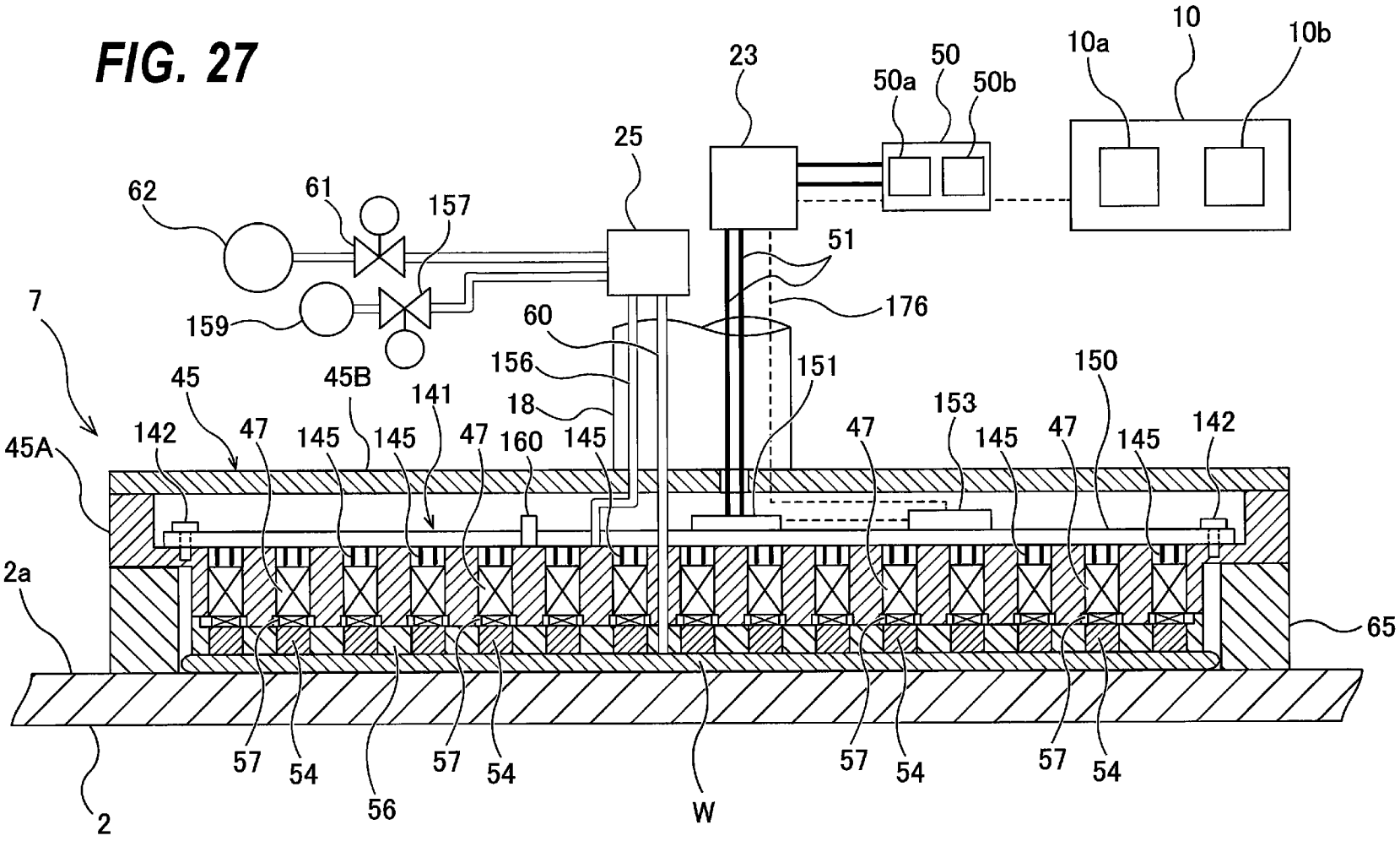
FIG. 27 is a cross-sectional view showing still another embodiment of the polishing head system.

FIG. 27 is a cross-sectional view showing still another embodiment of the polishing head 7. Configurations and operations of this embodiment, which will not be particularly described, are the same as those of any of the embodiments described with reference to FIG. 1 to FIG. 25, and duplicated descriptions will be omitted.

The polishing head system of this embodiment includes a voltage distributor 141 arranged in the polishing head 7. The voltage distributor 141 is detachably attached to the polishing head 7. More specifically, the voltage distributor 141 is fixed to the carrier 45 by positioning screws 142. The positioning screws 142 constitute a positioning device for fixing the position of the voltage distributor 141 relative to the piezoelectric elements 47. When the positioning screws 142 are removed, the voltage distributor 141 can be removed from the polishing head 7. When the voltage distributor 141 has been removed, a user can access the piezoelectric elements 47 and can repair or replace the piezoelectric elements 47 as needed.

The voltage distributor 141 includes a plurality of contact pins 145 that electrically contact electrodes of the plurality of piezoelectric elements 47, a base 150 that holds the contact pins 145, a branch device 151 that distributes the voltage to the contact pins 145, and a communication device 153 coupled to the branch device 151. The branch device 151 is electrically coupled to the power supply unit 50*a* of the drive-voltage application device 50 via the power lines 51 and the rotary connector 23. The electric power is supplied from the power supply unit 50*a* of the drive-voltage application device 50 to the branch device 151 through the power lines 51, and is further distributed from the branch device 151 to the plurality of contact pins 145.

The contact pins 145 protrude from the base 150 and are in contact with the electrodes of all the piezoelectric elements 47. The contact pins 145 are arranged such that two contact pins 145 are in contact with one piezoelectric element 47. The contact pins 145 are in contact with the electrodes of the piezoelectric elements 47, but are not fixed to the piezoelectric elements 47. Therefore, the voltage distributor 141 can be separated from the piezoelectric elements 47 simply by removing the positioning screws 142. When the voltage distributor 141 is fixed to the carrier 45 by the positioning screws 142, all contact pins 145 contact the corresponding piezoelectric elements 47.

The polishing head system further includes a purge-gas supply line 156 for supplying a purge gas into the polishing head 7, and a purge-gas supply valve 157 attached to the purge-gas supply line 156. In general, the piezoelectric elements 47 are likely to be affected by humidity, and the contact pins 145 may also suffer from an electrical failure, such as short circuit, due to the humidity. The purge gas reduces the humidity of the atmosphere surrounding the piezoelectric elements 47, and can therefore prevent electrical failures, such as the malfunctions of the piezoelectric elements 47 and the short circuit of the contact pins 145. The purge-gas supply line 156 extends from the inside of the polishing head 7 to a purge-gas supply source 159 via the rotary joint 25. The purge-gas supply source 159 supplies the purge gas, such as an inert gas (for example, a nitrogen gas) or dry air, to the purge-gas supply line 156.

The purge-gas supply valve 157 is coupled to the operation controller 10, so that the operation of the purge-gas supply valve 157 is controlled by the operation controller 10. The purge-gas supply line 156 extends through the base 150 of the voltage distributor 141 and communicates with a gap between the voltage distributor 141 and the housing 45A. When the operation controller 10 opens the purge-gas supply valve 157, the purge gas is supplied to the gap between the voltage distributor 141 and the housing 45A and contacts the piezoelectric elements 47.

A temperature measuring device 160, such as a temperature sensor, is arranged inside the polishing head 7. This is because the voltage dependence in the pressing forces of the piezoelectric elements 47 is generally affected by the element temperature, which leads to a decrease in the pressing forces particularly at a high temperature. Therefore, in order to measure the temperature of the piezoelectric elements 47, the temperature measuring device 160 is provided in the polishing head 7. In this embodiment, the temperature measuring device 160 is arranged on the base 150 of the voltage distributor 141. The temperature measuring device 160 is coupled to the communication device 153, and is further coupled to the operation controller 10 via the communication device 153. The temperature measuring device 160 faces the gap between the voltage distributor 141 and the housing 45A. The temperature measuring device 160 measures the temperature inside the polishing head 7, and transmits a measured value of the temperature to the operation controller 10 via the communication device 153. The measured value of the temperature is stored in the memory 10*a*.

The operation controller 10 may operate the purge-gas supply valve 157 based on the measured value of the temperature. Specifically, when the measured value of the temperature is higher than a threshold value, the operation controller 10 opens the purge-gas supply valve 157 to supply the purge gas to the inside of the polishing head 7. The purge gas is a gas having a regulated temperature, and can maintain a temperature in the polishing head 7 within an appropriate range. In particular, when the voltages are applied to the piezoelectric elements 47, the piezoelectric elements 47 generate heat depending on a pattern of the applied voltages. As a result, the inside of the polishing head 7 may be hot. According to this embodiment, the temperature inside the polishing head 7 can be maintained within an appropriate range with the supply of the purge gas.

Figure 28:
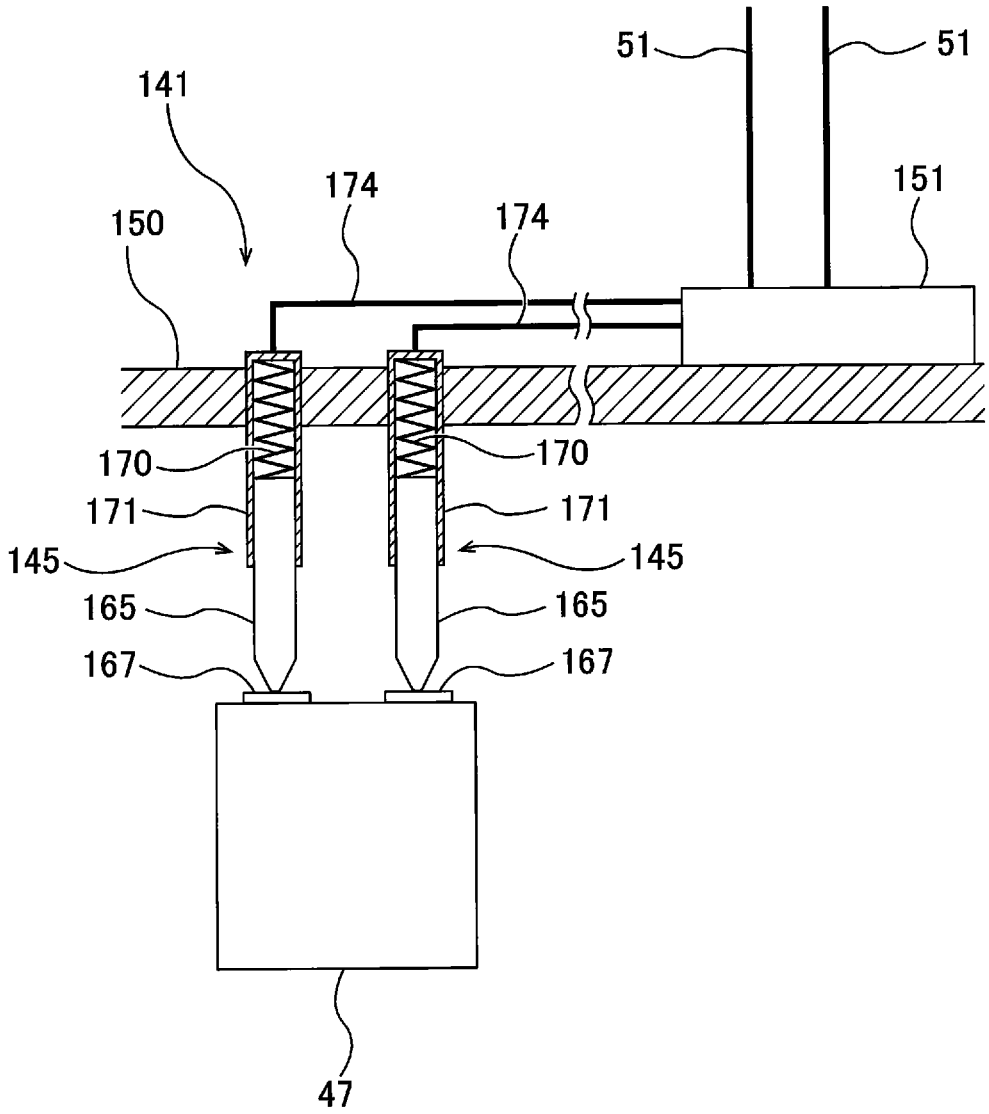
FIG. 28 is an enlarged view of contact pins shown in FIG. 27.

FIG. 28 is an enlarged view of the contact pins 145. Each contact pin 145 includes a plunger 165, a spring 170 that presses the plunger 165 against the electrode 167 of the piezoelectric element 47, and a casing 171 that houses the plunger 165 and the spring 170 therein. The plunger 165 and the casing 171 are made of a conductive material, such as metal. The casing 171 is coupled to a power distribution wire 174 extending from the branch device 151. The plunger 165 is electrically coupled to the power distribution wire 174 via the casing 171. The power distribution wire 174 may be a wire made of a conductive wire, or may be a wire formed on the base 150 by printing or the like.

The plunger 165 is pressed by the spring 170 against the electrode 167 of the piezoelectric element 47, thereby establishing an electrical connection between the branch device 151 and the piezoelectric element 47. According to this embodiment, the number of power lines 51 extending from the plurality of piezoelectric elements 47 to the power supply unit 50*a* can be reduced. In addition, the voltage distributor 141 can be easily removed, and as a result, the maintainability of the piezoelectric elements 47 is improved.

As shown in FIG. 27, the branch device 151 is coupled to the power supply unit 50*a* of the drive-voltage application device 50 via the power lines 51 and the rotary connector 23, so that the electric power is supplied from the power supply unit 50*a* to the branch device 151. The communication device 153 is coupled to the operation controller 10 via a communication line 176. The communication line 176 extends from the communication device 153 to the operation controller 10 via the rotary connector 23 and the voltage controller 50*b*. The operation controller 10 sends the instruction values of the voltage, to be applied to the piezoelectric elements 47, to the voltage controller 50*b* and the communication device 153. The communication device 153 in turn sends the instruction values of the voltage to the branch device 151. The branch device 151 distributes and applies the voltages, supplied from the power supply unit 50*a*, to the respective piezoelectric elements 47 based on the instruction values obtained from the communication device 153 and the instruction values obtained from the voltage controller 50*b*.

Figure 29:
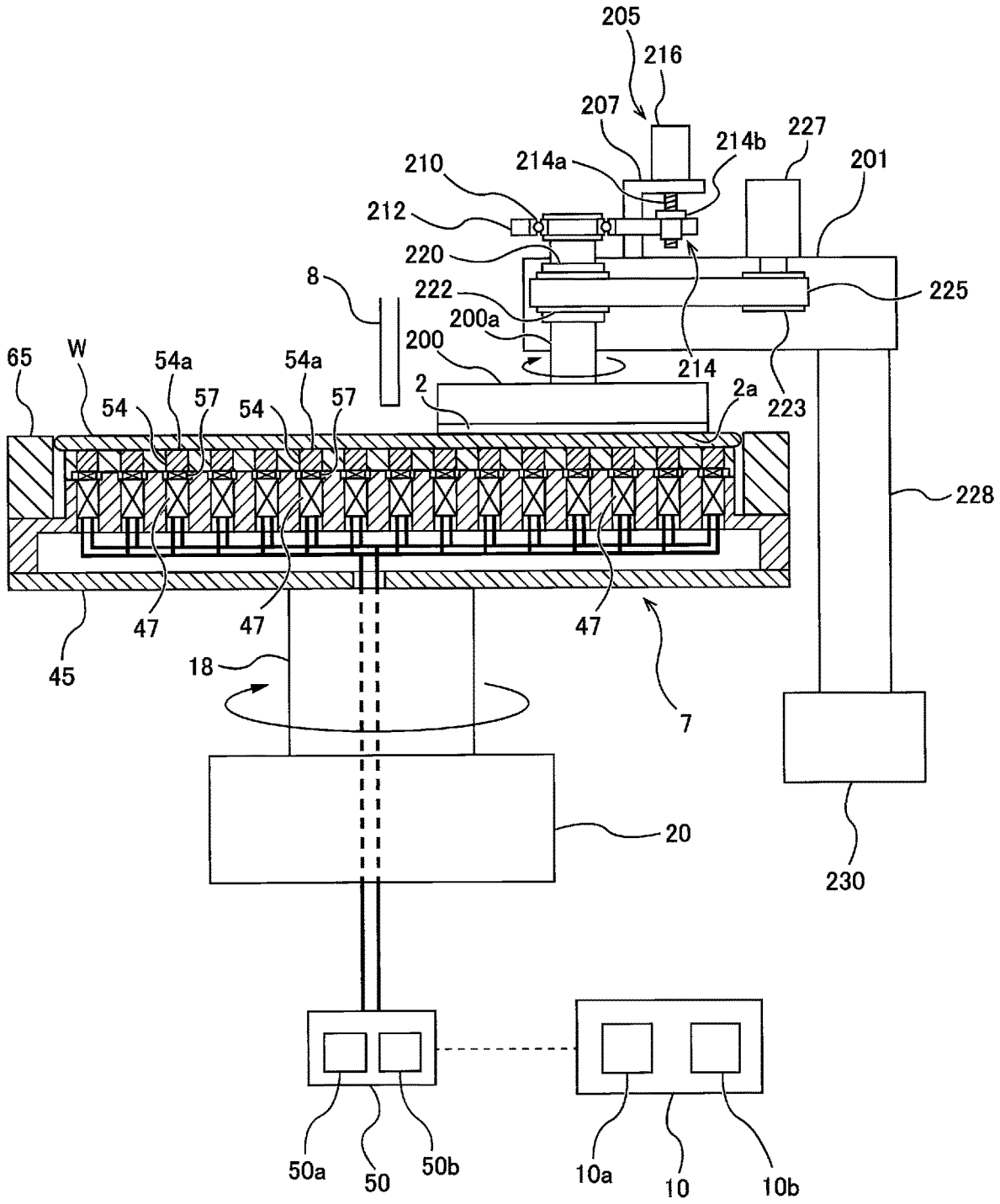
FIG. 29 is a schematic view showing another embodiment of the polishing apparatus.

The polishing head system according to the embodiments described with reference to FIG. 1 to FIG. 28 is not limited to a face-down type polishing apparatus in which the surface, to be polished, of the workpiece W faces downward, as shown in FIG. 1. As shown in FIG. 29, the polishing head system can also be applied to a face-up type polishing apparatus in which the surface, to be polished, of the workpiece W faces upward. Hereinafter, a face-up type polishing apparatus shown in FIG. 29 will be described.

FIG. 29 is a schematic view showing another embodiment of the polishing apparatus. A polishing head 7 is arranged such that pressing surfaces 54*a* of pressing members 54 face upward. The surface, to be polished, of the workpiece W supported by the polishing head 7 faces upward. A polishing-liquid supply nozzle 8 and a pad supporting structure 200 that supports a polishing pad 2 are arranged above the polishing head 7. A lower surface of the polishing pad 2 constitutes a polishing surface 2*a*, which faces downward. The polishing pad 2 has a size smaller than that of the workpiece W.

The pad supporting structure 200 is fixed to a lower end of a rotating shaft 200*a*. The pad supporting structure 200 is supported by a support arm 201 via the rotating shaft 200*a* and an elevating mechanism 205. The rotating shaft 200*a* extends through the support arm 201. The rotating shaft 200*a* is moved up and down with respect to the support arm 201 by the elevating mechanism 205. The vertical movement of the rotating shaft 200*a* causes the pad supporting structure 200 and the polishing pad 2 to move up and down relative to the support arm 201 for positioning of the pad supporting structure 200 and the polishing pad 2.

The elevating mechanism 205 is fixed to a support base 207. The support base 207 is fixed to the support arm 201. The elevating mechanism 205 includes a bearing 210 that rotatably supports the rotating shaft 200*a*, a bridge 212 that holds the bearing 210, a ball-screw mechanism 214 coupled to the bridge 212, and a servomotor 216 fixed to the support base 207.

The ball-screw mechanism 214 includes a screw shaft 214*a* coupled to the servomotor 216, and a nut 214*b* into which the screw shaft 214*a* is screwed. The nut 214*b* is held by the bridge 212. The rotating shaft 200*a* can move up and down together with the bearing 210 and the bridge 212. When the servomotor 216 is actuated, the bridge 212 moves up and down via the ball-screw mechanism 214, whereby the rotating shaft 200*a*, the pad supporting structure 200, and the polishing pad 2 move up and down.

The rotating shaft 200*a* is supported by a ball spline bearing 220 so as to be movable in the axial direction of the rotating shaft 200*a*. A pulley 222 is fixed to an outer peripheral portion of the ball spline bearing 220. A rotating motor 227 is fixed to the support arm 201, and the pulley 222 is coupled to a pulley 223 attached to the rotating motor 227 via a belt 225. When the rotating motor 227 is actuated, the ball spline bearing 220 and the rotating shaft 200*a* rotate together via the pulley 223, the belt 225, and the pulley 222, so that the pad supporting structure 200 and the polishing pad 2 rotate together with the rotating shaft 200*a*.

The support arm 201 is supported by a pivot shaft 228. The pivot shaft 228 is coupled to an oscillation device 230. The oscillation device 230 has an electric motor (not shown) for rotating the pivot shaft 228. When the oscillation device 230 rotates the pivot shaft 228 clockwise and counterclockwise alternately by a predetermined angle, the support arm 201 swings around the pivot shaft 228, whereby the pad supporting structure 200 and the polishing pad 2 coupled to the support arm 201 reciprocate in the radial direction on the surface of the workpiece W.

The carrier 45 of the polishing head 7 is fixed to an upper end of polishing-head shaft 18. The polishing-head shaft 18 is coupled to the rotating motor 20, so that the polishing-head shaft 18 and the polishing head 7 are rotated together by the rotating motor 20. FIG. 29 shows an example in which the polishing head 7 according to the embodiment shown in FIG. 5 is applied to the polishing apparatus, while the polishing head 7 according to the above-described embodiments other than the embodiment shown in FIG. 5 can also be applied as well.

The workpiece W is polished as follows. The workpiece W, with its surface to be polished facing upward, is held by the polishing head 7. The operation controller 10 produces a film-thickness profile as shown in FIG. 4 from the measurement data of the film thickness of the workpiece W, and determines instructions value of the voltage to be applied to the piezoelectric elements 47 based on the film-thickness profile. The operation controller 10 then transmits the instruction values to the voltage controller 50*b* of the drive-voltage application device 50. The voltage controller 50*b* instructs the power supply unit 50*a* to apply the voltages to the corresponding piezoelectric elements 47 according to the instruction values, whereby the power supply unit 50*a* applies the voltages to the piezoelectric elements 47. While the pad supporting structure 200 and the polishing head 7 are rotated in the direction indicated by arrows shown in FIG. 29, the polishing liquid is supplied from the polishing-liquid supply nozzle 8 onto the surface, to be polished, of the workpiece W on the polishing head 7. The polishing surface 2*a* of the polishing pad 2, held by the pad supporting structure 200, contacts the surface of the workpiece W, while the oscillation device 230 moves the pad supporting structure 200 and the polishing pad 2 in the radial direction of the workpiece W. While the workpiece W is rotated by the polishing head 7 in the presence of the polishing liquid on the workpiece W, the workpiece W is rubbed with the polishing surface 2*a* of the polishing pad 2. The surface of the workpiece W is polished by the chemical action of the polishing liquid and the mechanical action of the abrasive grains contained in the polishing liquid or the polishing pad 2.

When the polishing pad 2 oscillates on the workpiece W by the support arm 201, a reaction force applied to the polishing pad 2 and the pad supporting structure 200 from the workpiece W changes due to the pressure distribution on the workpiece W by the piezoelectric elements 47. Therefore, the servomotor 216 may adjust the height of the polishing pad 2 or the pressing force of the polishing pad 2 on the workpiece W so as to balance the reaction force.

In the embodiment shown in FIG. 29, the diameter of the polishing pad 2 is smaller than the radius of the workpiece W, while in one embodiment the diameter of the polishing pad 2 may be larger than the radius of the workpiece W, or may be the same as the diameter of the workpiece W. In these cases, it may not be necessary to move the pad supporting structure 200 and the polishing pad 2 in the radial direction of the workpiece W during polishing of the workpiece W. The polishing-liquid supply nozzle 8 may be arranged inside the pad supporting structure 200, and the polishing liquid may be supplied onto the workpiece W through a through-hole (not shown) formed in the polishing pad 2. The shape and position of the polishing-liquid supply nozzle 8 are not particularly limited as long as the polishing-liquid supply nozzle 8 can supply the polishing liquid to the entire surface, to be polished, of the workpiece W.

Figure 30:
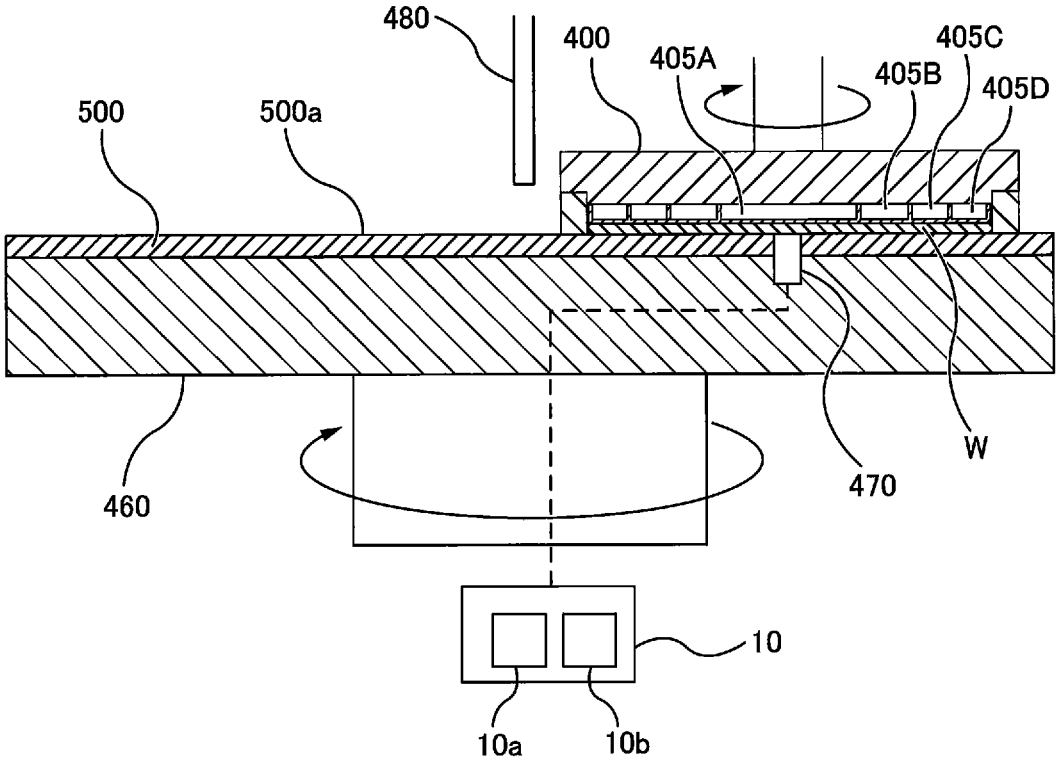
FIG. 30 is a schematic cross-sectional view showing a polishing apparatus including a polishing head having a plurality of pressure chambers.
Figure 32:
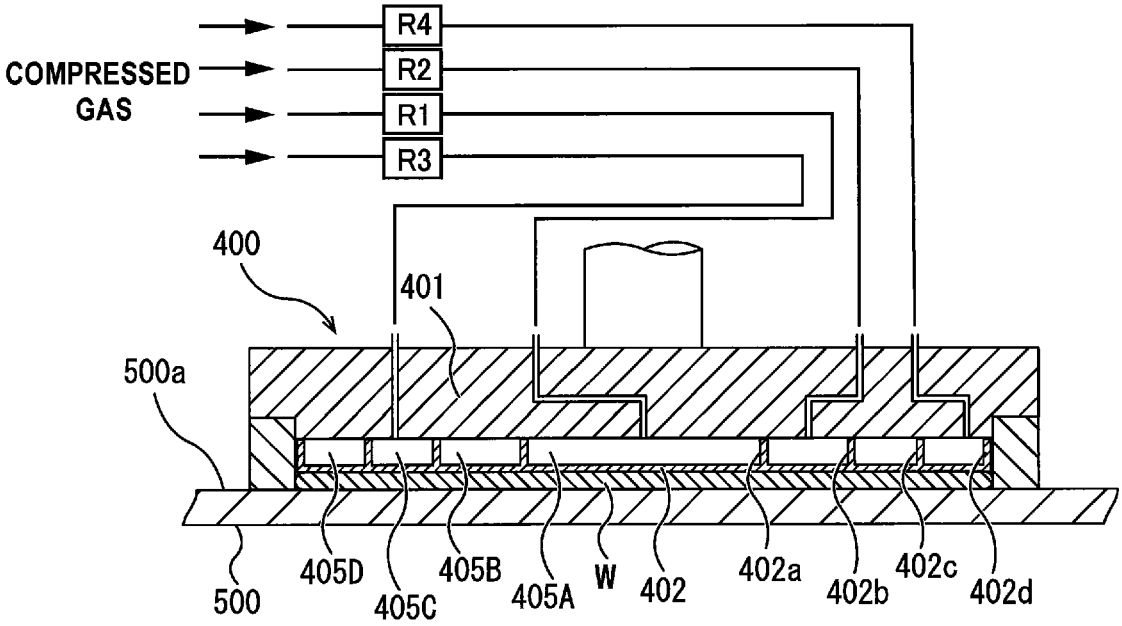
FIG. 32 is a cross-sectional view showing a conventional polishing head used for CMP.

The polishing apparatus including the polishing head 7 according to the embodiments described with reference to FIG. 1 to FIG. 29 may be used in combination with a polishing apparatus including a polishing head having a plurality of pressure chambers instead of the piezoelectric elements 47. FIG. 30 is a schematic cross-sectional view showing a polishing apparatus including a polishing head 400 having a plurality of pressure chambers 405A, 405B, 405C, and 405D. Since the polishing head 400 shown in FIG. 30 has the same configuration as the polishing head 400 described with reference to FIG. 32, duplicate descriptions thereof will be omitted. A film-thickness sensor 470, such as an eddy current sensor or an optical film-thickness sensor, is arranged in a polishing table 460. A polishing pad 500 is attached to an upper surface of the polishing table 460.

The workpiece W is polished as follows. While the polishing table 460 and the polishing head 400 are rotated independently, a polishing liquid (for example, slurry containing abrasive grains) is supplied from a polishing-liquid supply nozzle 480 onto a polishing surface 500*a* of the polishing pad 500. The polishing head 400 rotates the workpiece W and presses it against the polishing surface 500*a* of the polishing pad 500. The surface of the workpiece W is polished by a combination of the mechanical action of the abrasive grains contained in the polishing liquid or the polishing pad 500 and the chemical action of the chemical components of the polishing liquid.

During polishing of the workpiece W, the film-thickness sensor 470 generates film-thickness index values of the workpiece W and sends the film-thickness index values to the operation controller 10. The operation controller 10 produces a film-thickness profile of the entire surface, to be polished, of the workpiece W as shown in FIG. 4. The produced film-thickness profile is stored in the memory 10*a*.

Figure 31:
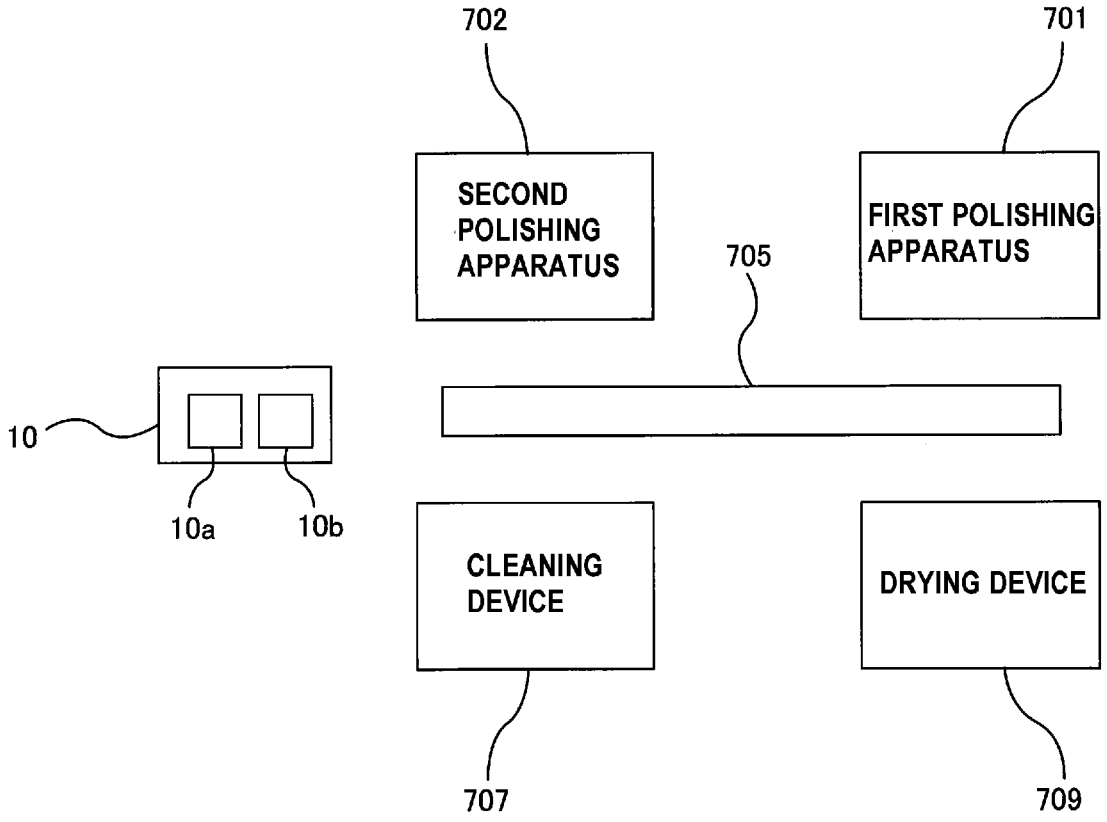
FIG. 31 is a schematic view showing a workpiece polishing system including the polishing apparatus having the polishing head according to any of the embodiments described with reference to FIG. 1 to FIG. 29, and the polishing apparatus described with reference to FIG. 30.

FIG. 31 is a schematic view showing a workpiece polishing system including the polishing apparatus having the polishing head 7 according to any of the embodiments described with reference to FIG. 1 to FIG. 29, and the polishing apparatus described with reference to FIG. 30. In the following descriptions, the polishing apparatus described with reference to FIG. 30 is referred to as a first polishing apparatus 701, and the polishing apparatus including the polishing head 7 according to any one of the embodiments described with reference to FIG. 1 to FIG. 29 is referred to as a second polishing apparatus 702.

The workpiece polishing system includes the first polishing apparatus 701, the second polishing apparatus 702, a transport device 705 for transporting the workpiece W, a cleaning device 707 for cleaning the polished workpiece W, a drying device 709 for drying the cleaned workpiece W, and the above-mentioned operation controller 10 for controlling the operations of the first polishing apparatus 701, the second polishing apparatus 702, the cleaning device 707, and the drying device 709. A plurality of first polishing apparatuses 701, a plurality of second polishing apparatuses 702, a plurality of cleaning devices 707, and a plurality of drying devices 709 may be provided.

The workpiece W is transported by the transport device 705 to the first polishing apparatus 701 described with reference to FIG. 30. The workpiece W is polished by the first polishing apparatus 701 (a first polishing process). The operation controller 10 produces a current film-thickness profile of the surface, to be polished, of the workpiece W as shown in FIG. 4 from the film-thickness index values acquired during the first polishing process. The produced film-thickness profile is stored in the memory 10*a*. The acquisition of the film-thickness index values during the first polishing process may be performed during polishing of the workpiece W with use of the polishing liquid, but the film-thickness index values may be acquired during a water polishing process in which the workpiece W and the polishing pad 2 are relatively moved while pure water is supplied for the purpose of removing the polishing liquid from the surface of the workpiece W after polishing of the workpiece W. Since the film of the workpiece W is not polished during the water polishing process, more accurate film-thickness index values can be obtained and thus a more accurate film-thickness profile can be produced.

The polished workpiece W is transported by the transport device 705 to the second polishing apparatus 702 including the polishing head 7 according to any of the embodiments described with reference to FIG. 1 to FIG. 29. The workpiece W is then polished by the second polishing apparatus 702 (a second polishing process). In the second polishing process, the arithmetic device 10*b* of the operation controller 10 determines the instruction values of the voltage required to achieve the target film-thickness profile based on the film-thickness profile acquired in the first polishing process. Thereafter, the operation controller 10 sends the instruction values to the voltage controller 50*b* of the drive-voltage application device 50, so that the power supply unit 50*a* applies the voltages to the piezoelectric elements 47 in the polishing head 7. As a result, the polishing head 7 presses the workpiece W against the polishing pad 2 to polish the surface of the workpiece W.

The workpiece W, which has been polished by the first polishing apparatus 701 and the second polishing apparatus 702, is transported to the cleaning device 707 by the transport device 705 and cleaned by the cleaning device 707. The cleaning device 707 may be a known cleaning device including a roll cleaning tool, a pen-type cleaning tool, or the like. The cleaned workpiece W is transported to the drying device 709 by the transport device 705 and dried by the drying device 709. The drying device 709 may be a known drying device, such as a spin drying device or a drying device using isopropyl alcohol (IPA).

The present invention can be applied not only to polishing of a circular workpiece but also to polishing of a polygonal workpiece, such as a rectangular or quadrangular workpiece.

The above-described embodiments can be combined as appropriate. For example, the elastic membrane 67 shown in FIG. 14 can be applied to the embodiments described with reference to FIG. 18 to FIG. 29.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing head system for polishing a workpiece by pressing the workpiece against a polishing surface while moving the workpiece and the polishing surface relative to each other in a presence of a polishing liquid, comprising:

a polishing head having a plurality of piezoelectric elements configured to apply downward pressing forces to a plurality of regions of the workpiece, and a carrier holding the plurality of piezoelectric elements, the carrier having stepped portions which are in contact with the plurality of piezoelectric elements to fix positions of the plurality of piezoelectric elements relative to the carrier, the polishing head further having a plurality of pressing members coupled to the plurality of piezoelectric elements, respectively; and the plurality of pressing members having a plurality of first surfaces facing the plurality of piezoelectric elements, respectively, a plurality of second surfaces for pressing the workpiece, and a holding member holding the plurality of pressing members such that the plurality of pressing members are movable within a limited range, wherein each pressing member includes an upper protrusion, a lower protrusion, and a body portion located between the upper protrusion and the lower protrusion, the body portion having a width smaller than widths of the upper protrusion and the lower protrusion, and the holding member having a supporting portion that movably supports the body portion;

a drive-voltage application device including a power supply unit and a voltage controller, the power supply unit being configured to apply voltages to the plurality of piezoelectric elements independently; and an operation controller configured to determine a plurality of instruction values of the voltages to be applied to the plurality of piezoelectric elements and transmits the plurality of instruction values to the drive-voltage application device.

2. The polishing head system according to claim 1, wherein the plurality of piezoelectric elements is arranged along a radial direction and a circumferential direction of the polishing head.

3. The polishing head system according to claim 2, wherein an arrangement of the plurality of piezoelectric elements in the polishing head is any one or a combination of a grid arrangement, a concentric arrangement, and a staggered arrangement.

4. The polishing head system according to claim 1, wherein the plurality of second surfaces have at least one of a circular shape, an ellipse shape, a polygonal shape, and an arc shape.

5. The polishing head system according to claim 1, wherein a facing area of the plurality of first surfaces is larger than a facing area of the plurality of second surfaces.

6. The polishing head system according to claim 1, wherein at least two piezoelectric elements are coupled to one pressing member.

7. The polishing head system according to claim 1, wherein the holding member is configured to limit a range of movement of the plurality of pressing members in a direction perpendicular to a direction of pressing the workpiece.

8. The polishing head system according to claim 1, wherein:

the plurality of pressing members include a plurality of gimbal mechanisms, respectively, the plurality of gimbal mechanisms having a plurality of movable members which are tiltable in all directions; and the plurality of movable members have the plurality of second surfaces, respectively.

9. The polishing head system according to claim 1, wherein the polishing head further includes an elastic membrane having a contact surface with the workpiece.

10. The polishing head system according to claim 1, further comprising:

an elastic membrane forming a pressure chamber in the polishing head; and a compressed-gas supply line communicating with the pressure chamber, the pressure chamber being located between the plurality of pressing members and the elastic membrane.

11. The polishing head system according to claim 1, further comprising:

an elastic sheet forming a pressure chamber in the polishing head; and a compressed-gas supply line communicating with the pressure chamber, the plurality of piezoelectric elements being located between the elastic sheet and the plurality of pressing members.

12. The polishing head system according to claim 1, wherein the polishing head further includes a plurality of pressing-force measuring devices configured to measure pressing forces generated by the plurality of piezoelectric elements, respectively.

13. The polishing head system according to claim 12, wherein the plurality of pressing-force measuring devices are arranged between the plurality of piezoelectric elements and the plurality of pressing members.

14. The polishing head system according to claim 12, wherein the plurality of pressing-force measuring devices are a plurality of piezoelectric sensors.

15. The polishing head system according to claim 1, wherein the polishing head further includes a voltage distributor electrically coupled to the drive-voltage application device and the plurality of piezoelectric elements, the voltage distributor being configured to distribute the voltage applied from the drive-voltage application device to the plurality of piezoelectric elements.

16. The polishing head system according to claim 15, wherein the voltage distributor has a branch device configured to distribute the voltage applied from the drive-voltage application device to the plurality of piezoelectric elements, and a communication device coupled to the branch device and the drive-voltage application device.

17. The polishing head system according to claim 16, wherein the voltage distributor further has a plurality of plungers contacting the plurality of piezoelectric elements, and power distribution wires electrically coupling the plurality of plungers to the branch device.

18. The polishing head system according to claim 15, wherein the voltage distributor is detachably attached to the polishing head.

19. The polishing head system according to claim 1, wherein the polishing head further includes a temperature measuring device configured to measure a temperature of the plurality of piezoelectric elements.

20. The polishing head system according to claim 1, further comprising a vacuum line communicating with a workpiece contact surface of the polishing head.

21. The polishing head system according to claim 1, wherein:

the polishing head further includes a retainer ring located outwardly of the plurality of piezoelectric elements; and at least three workpiece chuck mechanisms fixed to the retainer ring.

22. The polishing head system according to claim 1, wherein the power supply unit is a DC power supply.

23. A polishing apparatus for a workpiece, comprising:

a polishing table configured to hold a polishing pad;

a polishing-liquid supply nozzle configured to supply a polishing liquid to the polishing pad; and the polishing head system according to claim 1.

24. The polishing apparatus according to claim 23, further comprising a film-thickness sensor configured to measure a film thickness of the workpiece, the film-thickness sensor being arranged in the polishing table.

25. The polishing apparatus according to claim 24, wherein the operation controller is configured to produce a film-thickness profile of the workpiece from measured values of the film thickness acquired by the film-thickness sensor, and to determine instruction values of the voltages to be applied to the plurality of piezoelectric elements based on the film-thickness profile.

26. The polishing apparatus according to claim 25, wherein the operation controller is configured to determine the instruction values of the voltages to be applied to the plurality of piezoelectric elements based on a difference between the film-thickness profile and a target film-thickness profile.

27. The polishing apparatus according to claim 23, further comprising a loading and unloading device configured to allow the polishing head to hold the workpiece.

28. The polishing apparatus according to claim 23, further comprising an orientation detector configured to detect an orientation of the workpiece in its circumferential direction.

29. A polishing system for polishing a workpiece, comprising:

the polishing apparatus according to claim 23;

a cleaning device configured to clean the workpiece after polishing of the workpiece;

a drying device configured to dry the workpiece after cleaning of the workpiece; and a transport device configured to transport the workpiece between the polishing apparatus, the cleaning device, and the drying device.

* * * * *